US009804514B2

(12) United States Patent
Suzumura et al.

(10) Patent No.: US 9,804,514 B2
(45) Date of Patent: Oct. 31, 2017

(54) METHOD FOR PRODUCING TONER

(71) Applicant: CANON KABUSHIKI KAISHA, Tokyo (JP)

(72) Inventors: Yoshitaka Suzumura, Mishima (JP); Yusuke Hasegawa, Suntou-gun (JP); Tomohisa Sano, Mishima (JP); Yuujirou Nagashima, Susono (JP); Kozue Uratani, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/259,114

(22) Filed: Sep. 8, 2016

(65) Prior Publication Data

US 2017/0160657 A1 Jun. 8, 2017

(30) Foreign Application Priority Data

Dec. 4, 2015 (JP) ..... 2015-237857

(51) Int. Cl.
*G03G 9/087* (2006.01)
*G03G 9/08* (2006.01)

(52) U.S. Cl.
CPC ..... *G03G 9/0806* (2013.01); *G03G 9/08711* (2013.01)

(58) Field of Classification Search
CPC ... G03G 9/0802; G03G 9/0804; G03G 9/0821
See application file for complete search history.

(56) References Cited

U.S. PATENT DOCUMENTS

| | | | |
|---|---|---|---|
| 6,586,151 | B1 | 7/2003 | Naka et al. |
| 6,803,164 | B2 | 10/2004 | Mizoo et al. |
| 6,953,646 | B2 | 10/2005 | Doujo et al. |
| 7,123,862 | B2 | 10/2006 | Hasegawa et al. |
| 7,160,660 | B2 | 1/2007 | Dojo et al. |
| 7,368,211 | B2 | 5/2008 | Hasegawa et al. |
| 7,470,494 | B2 | 12/2008 | Nishiyama et al. |
| 7,582,401 | B2 | 9/2009 | Ogawa et al. |
| 7,678,523 | B2 | 3/2010 | Hiroko et al. |
| 7,678,524 | B2 | 3/2010 | Hasegawa et al. |
| 7,704,659 | B2 | 4/2010 | Ogawa et al. |
| 7,811,734 | B2 | 10/2010 | Ogawa et al. |

(Continued)

FOREIGN PATENT DOCUMENTS

| | | |
|---|---|---|
| JP | 2010-145550 | 7/2010 |
| JP | 2014-211632 | 11/2014 |

OTHER PUBLICATIONS

U.S. Appl. No. 15/191,707, Satoshi Arimura, filed Jun. 24, 2016.

(Continued)

*Primary Examiner* — Peter Vajda
(74) *Attorney, Agent, or Firm* — Fitzpatrick Cella Harper and Scinto

(57) ABSTRACT

Provided is a method for producing a toner, the method including a treatment process of treating a coloring particle including a binder resin, a colorant, a crystalline polyester, and a wax in an aqueous medium, wherein, the peak temperature of a crystallization peak (Pp) in the crystalline polyester is denoted by Tp (° C.) and the peak temperature of a crystallization peak (Pw) in the wax is denoted by Tw (° C.), the Tp and Tw satisfy a specific relationship, and the treatment process has a specific cooling step.

6 Claims, 5 Drawing Sheets

(56) References Cited

U.S. PATENT DOCUMENTS

| | | | |
|---|---|---|---|
| 7,923,190 | B2 | 4/2011 | Magome et al. |
| 7,935,467 | B2 | 5/2011 | Dojo et al. |
| 7,939,231 | B2 | 5/2011 | Ogawa et al. |
| 8,084,174 | B2 | 12/2011 | Hasegawa et al. |
| 8,124,306 | B2 | 2/2012 | Hirata et al. |
| 8,227,162 | B2 | 7/2012 | Sano et al. |
| 8,426,091 | B2 | 4/2013 | Magome et al. |
| 8,426,094 | B2 | 4/2013 | Magome et al. |
| 8,518,620 | B2 | 8/2013 | Dojo et al. |
| 8,614,044 | B2 | 12/2013 | Matsui et al. |
| 8,778,585 | B2 | 7/2014 | Matsui et al. |
| 8,841,054 | B2 | 9/2014 | Dojo et al. |
| 8,918,035 | B2 | 12/2014 | Hasegawa et al. |
| 9,029,055 | B2 | 5/2015 | Aoki et al. |
| 9,097,997 | B2 | 8/2015 | Nomura et al. |
| 9,152,065 | B2 | 10/2015 | Sano et al. |
| 9,158,216 | B2 | 10/2015 | Shimano et al. |
| 9,213,250 | B2 | 12/2015 | Nomura et al. |
| 9,213,251 | B2 | 12/2015 | Ohmori et al. |
| 9,217,943 | B2 | 12/2015 | Matsui et al. |
| 9,235,151 | B2 | 1/2016 | Tanaka et al. |
| 9,239,528 | B2 | 1/2016 | Hasegawa et al. |
| 9,244,371 | B2 | 1/2016 | Suzumura et al. |
| 9,304,422 | B2 | 4/2016 | Matsui et al. |
| 9,348,246 | B2 | 5/2016 | Magome et al. |
| 9,354,545 | B2 | 5/2016 | Matsui et al. |
| 9,377,708 | B2 | 6/2016 | Magome et al. |
| 9,417,542 | B2 | 8/2016 | Hiroko et al. |
| 9,423,710 | B2 | 8/2016 | Magome et al. |
| 9,423,711 | B2 | 8/2016 | Uratani et al. |
| 9,442,416 | B2 | 9/2016 | Magome et al. |
| 9,454,096 | B2 | 9/2016 | Hasegawa et al. |
| 2009/0197192 | A1 | 8/2009 | Hiroko et al. |
| 2012/0045717 | A1 | 2/2012 | Hiroko et al. |
| 2015/0185658 | A1 | 7/2015 | Wakabayashi et al. |
| 2015/0227067 | A1 | 8/2015 | Sano et al. |
| 2015/0227068 | A1 | 8/2015 | Sano et al. |
| 2015/0261110 | A1* | 9/2015 | Nakagawa ..... G03G 9/0804 430/137.1 |
| 2016/0139521 | A1 | 5/2016 | Tsuda et al. |
| 2016/0154331 | A1 | 6/2016 | Tanaka et al. |
| 2016/0266509 | A1 | 9/2016 | Sano et al. |

OTHER PUBLICATIONS

U.S. Appl. No. 15/256,780, Yusuke Hasegawa, filed Sep. 6, 2016.
U.S. Appl. No. 15/259,293, Yoshitaka Suzumura, filed Sep. 8, 2016.
U.S. Appl. No. 15/333,297, Shiro Kuroki, filed Oct. 25, 2016.

* cited by examiner

METHOD FOR PRODUCING TONER

BACKGROUND OF THE INVENTION

Field of the Invention

The present invention, relates to a method for producing a toner that is suitable for an electrophotographic method, an electrostatic recording method, and a magnetic recording method.

Description of the Related Art

In recent years, the increased variety of intended uses and usage environments of linage forming apparatuses, such as copiers and printers, created a demand for additional energy saving. Energy saving improvements resulting from toner are primarily associated with toners with a further improved low-temperature fixability.

As a means tor creating such toners, the use of crystalline polyesters which rapidly compatibilize with the binder resin of the toner and enhance melting deformation of the toner has been actively studied in recent years.

Crystalline polyesters which are highly effective in improving low-temperature fixability are capable of easily compatibilizing with the binder resin in the vicinity of the melting point of the crystalline polyesters, and the toner tends to melt and deform rapidly at the time of fixing. This is why the low-temperature mixability of the toner is increased as a result of using the crystalline polyester.

Further, additional improvement in the fixing ability can be expected from the usage of a release agent, such as a wax, which can impart the toner with releasability with respect to a fixing unit.

However, since the crystalline polyesters are capable of easily compatibilizing with the binder resin, the crystalline polyester becomes easily present on the toner surface, thereby reducing the charging performance of the toner. An additional problem is that where the toner is stored in a severe environment with a temperature and humidity higher than usual, the polyester resin which has compatilibized with the binder resin is annealed by this temperature and crystallizes. The abovementioned environment will be referred to as "severe environment", and allowing the toner to stand in such environment will be referred to as "storage in the severe environment". Where such problem occurs, the surface composition of the toner-changes in the course of storage in the severe environment, and performance thereof is greatly degraded, for example, by occurrence of fogging.

Reducing the amount of the polyester resin compatibilized with the resin binder has been investigated to resolve this problem. Reducing the compatibilized amount means that a state with a high degree of crystallinity of the crystalline polyester is achieved. In particular, methods for producing toners that are aimed at the crystallization of the crystalline polyesters have been studied.

In Japanese Patent Application Publication No. 2010-145550, the degree of crystallinity of a crystalline polyester is increased by controlling the cooling rate. In Japanese Patent Application Publication No. 2014-211632, an annealing treatment step is provided in the cooling process to increase the degree of crystallinity of a crystalline polyester.

However, in terms of the decrease in charging performance caused by the presence of a crystalline polyester on the toner surface, and the resistance to storage in the severe environment in which a variety of material flows are assumed to occur, there is still room for improvement with respect to the abovementioned patent literature. Thus, there is room for investigating the techniques for encapsulating a crystalline polyester in a state with a high degree of crystallinity in a toner.

SUMMARY OF THE INVENTION

The present invention provides a method for producing a toner that increases the degree of crystallinity of a crystalline polyester and encapsulates the crystalline polyester in the toner.

The inventors have found conditions under which in a toner using a wax together with a crystalline polyester, the crystallization of the crystalline polyester can be advanced by using crystal nuclei of the wax for the crystallization of the crystalline polyester. This finding led to the creation of the present invention.

Thus, the present invention is disclosed hereinbelow.

A method for producing a toner including a binder resin, a colorant, a crystalline polyester, and a wax, wherein the crystalline polyester and the wax satisfy the following Formula (1), $$45<Tp+5<Tw<100 \qquad \text{Formula (1)}$$

where Tp (° C.) represents a peak temperature of a crystallization peak (Pp) in the crystalline polyester measured by differential scanning calorimetry (DSC), and Tw (° C.) represents a peak temperature of a crystallization peak (Pp) in the wax measured by differential scanning calorimetry, the method comprising the steps of:

(i) setting a temperature of an aqueous medium in which a coloring particle is dispersed to at least Tw, the coloring particle including the binder resin, the colorant, the crystalline polyester, and the wax;

(ii) cooling the aqueous medium at a cooling rate of at least 5.0° C./min after the step (i) in a temperature range where an integral value relative to a total area of the Pw becomes at least 70%, the total area being taken as 100%;

(iii) obtaining the toner particle by the following step (a) or (b):

(a) holding the aqueous medium in a temperature range of the Pp for at least 30 min; or (b) cooling the aqueous medium at a cooling rate of not more than 1.0° C./min after the step (ii) in a temperature range where an integral value relative to a total area of the Pp becomes at least 50%, the total area being taken as 100%.

Further features of the present invention will become apparent from the following description of exemplary embodiments (with reference to the attached drawings).

DESCRIPTION OF THE EMBODIMENTS

Figure 1:
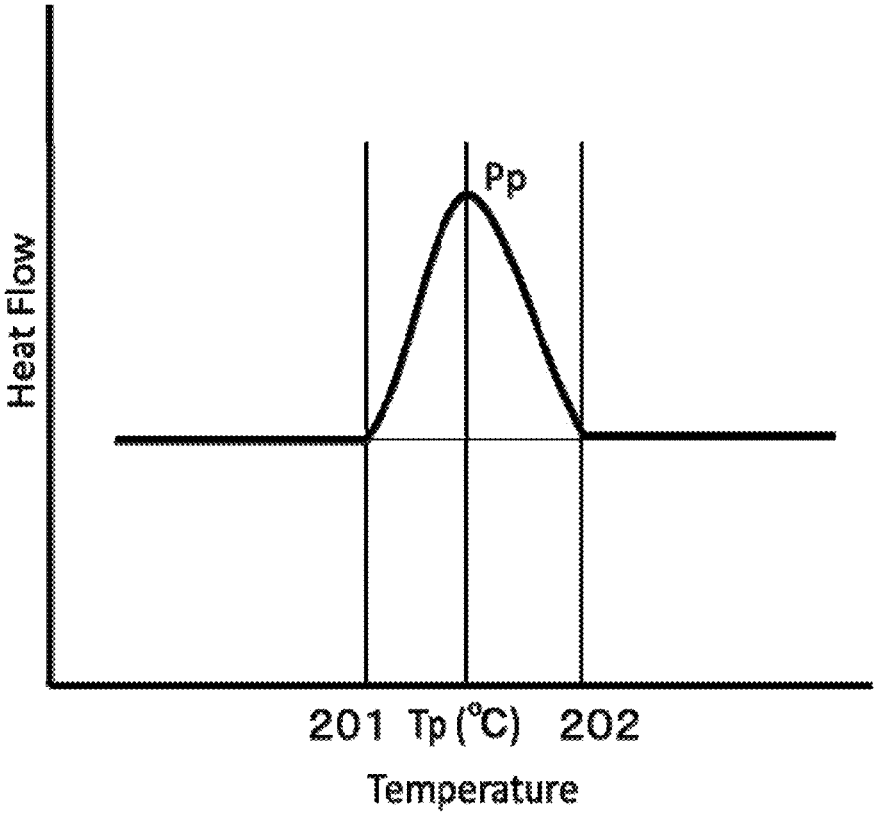
FIG. 1 illustrates an example of the crystallization peak of a crystalline polyester in DSC.

The present invention provides a method for producing a toner having a toner particle including a binder resin, a colorant, a crystalline polyester, and a wax, wherein the crystalline polyester and the wax satisfy the following Formula (1), $$45<Tp+5<Tw<100 \quad \text{Formula (1)}$$

(in Formula (1), Tp (° C.) represents a peak temperature of a crystallization peak (Pp) in the crystalline polyester measured by differential scanning calorimetry (DSC), and Tw (° C.) represents a peak temperature of a crystallization peak (Pw) in the wax measured by differential scanning calorimetry (DSC)), the method including the steps of:

(i) setting a temperature of an aqueous medium in which a coloring particle is dispersed to at least the Tw, the coloring particle including the binder resin, the colorant, the crystalline polyester, and the wax;

(ii) cooling the aqueous medium at the cooling rate of at least 5.0° C./min after the step (i) in a temperature range where an integral value relative to a total area of the Pw becomes at least 70%, the total area being taken as 100%; and (iii) obtaining the toner particle by the following step (a) or (b):

(a) holding the aqueous medium in a temperature range of the Pp for at least 30 min after the step (ii), (b) cooling the aqueous medium at a cooling rate of not more than 1.0° C./min after the step (ii) in a temperature range where an integral value relative to a total area of the Pp becomes at least 50%, the total area being taken as 100%.

When crystalline polyester exudes to the surface of a toner, the charging performance of the toner is greatly reduced and electrophotographic characteristics are degraded, for example, fogging occurs.

Even where there is no exuding to the toner surface, when the crystalline polyester has compatibilized with a binder resin and the toner is stored in a severe environment in which the toner is greatly affected by temperature and humidity, the crystalline polyester is annealed and crystallized and exudes to the toner surface.

The investigation conducted by the inventors revealed that where a crystalline polyester has been crystallized in an aqueous medium, the crystallization easily proceeds in a state in which the crystalline polyester is encapsulated in the toner.

Meanwhile, where the crystalline polyester has been crystallized in the air, the crystalline polyester, conversely, crystallizes while exuding to the toner surface.

The phenomenon in which the presence state of the crystalline polyester is changed depending on the environment in which the crystalline polyester crystallizes can be explained by the hydrophilicity-hydrophobicity of the crystalline polyester and the surrounding environment thereof.

The crystalline polyester is hydrophobic. Meanwhile, aqueous media are hydrophilic and the air is hydrophobic. In other words, where the crystalline polyester is crystallized in an aqueous medium, water and the crystalline polyester have a low affinity and the crystalline polyester is unlikely to be present on the surface of the toner. Conversely, where the crystalline polyester is crystallized in air, that is, in the severe environment, the crystalline polyester and air have a high affinity and the crystalline polyester easily exudes to the toner surface. Thus, according to the investigation conducted by the inventors, in order to solve the problem of the crystalline polyester exuding to the toner surface, it is particularly important that the crystalline polyester inside the toner be crystallized in an aqueous medium.

According to the investigation conducted by the inventors, the degree of crystallinity in a state in which the crystalline polyester is encapsulated in a toner can be increased by obtaining the toner by the abovementioned production method.

The following issues are important from the standpoint of increasing the degree of crystallinity in a state in which the crystalline polyester is encapsulated in a toner.

(I) The process for producing the toner has the following steps (i), (ii), and (iii) of treating a coloring particle in an aqueous medium, the coloring particle including a binder resin, a colorant, a crystalline polyester, and a wax.

In the present invention, crystals of the crystalline polyester are grown by using the wax as crystal nuclei. Therefore, where the wax is not used together with the crystalline polyester, the degree of crystallinity of the crystalline polyester is insufficient.

(II) In the process for producing the toner, where Tp (° C.) represents a peak temperature of a crystallization peak (Pp) in the crystalline polyester measured by differential scanning calorimetry (DSC) and Tw (° C.) represents a peak temperature of a crystallization peak (Pw) in the wax measured by differential scanning calorimetry, the Tp and the Tw satisfy the following Formula (1).

$$45<Tp+5<Tw<100 \quad \text{Formula (1)}$$

In the cooling step described hereinbelow, Formula (1) above needs to be satisfied in order to initially crystallize the wax which is a release agent and form crystal nuclei thereof inside the toner and to grow the crystals of the crystalline polyester thereafter.

Where the relationship between Tp and Tw does not satisfy Formula (1), the degree of crystallinity of the crystalline polyester is insufficient, or the temperature in the cooling step is difficult to control.

The preferred range of Tp and Tw is represented by Formula (2) below.

$$45<Tp+15<Tw<100 \quad \text{Formula (2)}$$

(III) The coloring particle is treated in the following steps (i), (ii), and (iii).

All these steps are carried out in an aqueous medium. As a result of crystallizing the crystalline polyester in the aqueous medium, the crystalline polyester is crystallized inside the toner at the time of crystallization. Therefore, the crystalline polyester can be encapsulated in the toner in a state with a high degree of crystallinity. Performing the same treatment in a high-temperature environment such as air, rather than an aqueous medium, is disadvantageous because the crystalline polyester crystallizes at the toner surface.

In order to obtain such an effect, all of the steps (i), (ii), and (iii) are needed. Where only some of the steps are performed, the crystalline polyester would be present on the surface of the toner, or the degree of crystal Unity would be insufficient. As a result, the occurrence of fogging during the storage in the severe environment cannot be suppressed.

The abovementioned treatment steps include the step (i) of setting the temperature of the aqueous medium in which the coloring particle is dispersed to at least the Tw.

With the step (i) of setting the temperature of the aqueous medium in which the coloring particle is dispersed to at least the Tw, the crystalline polyester and wax in the coloring particle can be sufficiently compatibilized with the binder resin.

When the temperature is not set to at least the Tw, the crystalline polyester which has already been present on the surface of the toner cannot be encapsulated, which is undesirable.

The temperature of the aqueous medium in which the coloring particle has been dispersed is preferably at least Tw+10° C. and more preferably at least Tw+15° C. The upper limit of the temperature of the aqueous medium is about Tw+30° C.

The abovementioned treatment steps include the step (ii) of cooling the aqueous medium at the cooling rate of at least 5.0° C./min after the step (i) in a temperature range where an integral value relative to a total area of the Pw becomes at least 70%, the total area being taken as 100%.

Cooling the aqueous medium at the cooling rate of at least 5.0° C./min indicates cooling at a comparatively high rate and is called "rapid cooling".

As a result of cooling at a comparatively high rate, crystal growth of the wax is suppressed and a state is reached in which a large amount of fine crystal nuclei of the wax is dispersed in the toner.

When the integral value of the temperature range in which the abovementioned cooling rate is satisfied is less than 70% relative to the total area of the Pw, crystal growth of the wax is advanced and the below-described degree of crystallinity of the crystalline polyester is not increased.

Further, where the cooling rate is less than 5.0° C./min, the crystal nuclei of the wax grow. As a result, the number of the below-described base points for the crystal growth of the crystalline polyester is decreased and the degree of crystallinity of the crystalline polyester is not increased.

The cooling rate is preferably at least 10.0° C./min, more preferably at least 30.0° C./min, and even more preferably at least 50.0° C./min, and the upper limit of the cooling rate is about 3,000° C./min at which the effect thereof is saturated.

The abovementioned treatment steps include the step (iii) of (a) holding the aqueous medium in a temperature range of the Pp for at least 30 min after the step (ii), or the step (iii) of (b) cooling the aqueous medium at a cooling rate of not more than 1.0° C./min after the step (ii) in a temperature range where an integral value relative to a total area of the Pp becomes at least 50%, the total area being taken as 100%.

As a result of performing the step (iii) after the step (i) and step (ii), the wax formed by in the step (ii) serves as crystal nuclei, the crystal growth of the crystalline polyester is advanced, and the degree of crystallinity of the crystalline polyester can be increased.

In order to advance the crystal growth of the crystalline polyester, the step (a) or step (b) is implemented.

In step (a), annealing treatment is performed at a temperature in a range of the crystallization peak of the crystalline polyester. As a result, the degree of crystallinity of the crystalline polyester can be increased. The holding time is preferably at least: 100 min, more preferably at least 180 min. The upper limit of the holding time is about 1,440 min at which the effect thereof is saturated. In the step (a), from the standpoint of maintaining the dispersed state of the wax, it is preferred that the temperature at the upper end of the crystallization peak range of the crystalline polyester be not higher than the temperature at the lower end of the crystallization peak range of the wax.

In the step (b), cooling is performed at a comparatively low cooling rate of not more than 1.0° C./min in the entire temperature range of the crystallization peak of the crystalline polyester or a part thereof.

In the present invention, the cooling at a rate of not more than 1.0° C./min is called "gradual cooling". As a result, the effect same as that of the annealing treatment can be obtained and the degree of crystallinity of the crystalline polyester can be increased.

When the integral value of the temperature range where the aforementioned cooling rate is satisfied is less than 50% relative to the total area of the Pp, the crystallization, of the crystalline polyester becomes insufficient which is undesirable.

The cooling rate is preferably not more than 0.50° C./min, more preferably not more than 0.01° C./min.

In the present invention, the crystallization peaks of the crystalline polyester and wax can be determined from the exothermic curve at the time the temperature is lowered, the curve being obtained from the analysis of the toner including the crystalline polyester and wax, or individual analysis of the crystalline polyester and wax by using a differential scanning calorimeter (DSC).

FIG. 1 shows an example of the exothermic curve at the time the temperature is lowered for the crystalline polyester alone. In the exothermic curve, the peak temperature of the crystallization peak (Pp) of the crystalline polyester, which is the temperature at which the heat generation amount is at a maximum, is taken as Tp (° C.). Further, the base line relating to the peak of the exothermic curve is pulled, and a high temperature and low temperature among the temperatures at which the exothermic curve deviates from the base line are called "upper end" and "lower end", respectively.

Maintaining the temperature in the Pp region in the aforementioned step (a) means that the temperature of the aqueous medium is maintained at any temperature between the upper end and lower end.

The total area of the crystallization peak (Pp) is the area bounded by the base line and Pp, where the base line of the crystallization peak (Pp) is pulled.

Figure 2:
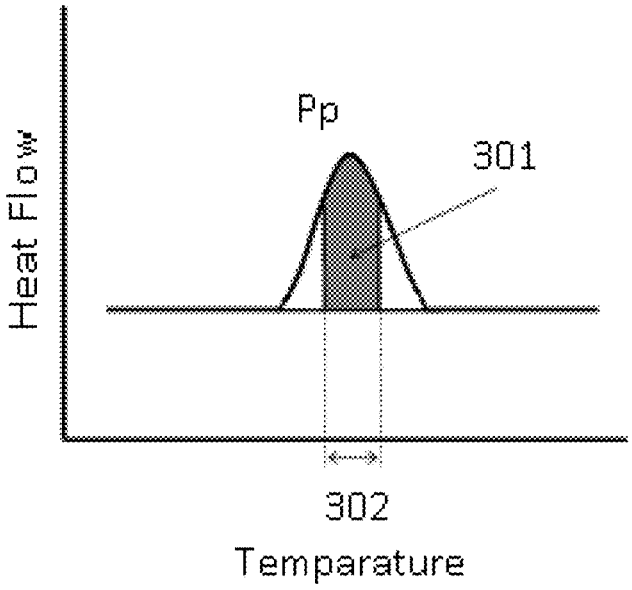
FIG. 2 illustrates an example of the integral value of the crystallization peak of a crystalline polyester in DSC.

FIG. 2 shows an example of a temperature range in which the integral value relative to the total area becomes 50%, the total area of the Pp being taken as 1.00%. Where an area bounded by the base line, Pp, and a specific temperature range (that is, the integral value of the Pp in a specific temperature range) becomes 50% relative to the total area, the "temperature range in which the integral value relative to the total area becomes 50%" means the specific temperature range. The meaning of the "temperature range in which the integral value relative to the total area becomes 50%" is in the present amount of the crystalline polyester component in this temperature range. Therefore, by applying the specific cooling conditions to the "temperature range in which the integral value relative to the total area becomes at least 50%", it is possible to control the crystallization of at least 50% of the crystalline polyester component. By controlling at least 50% of the crystalline polyester, it is also possible to perform tracking control of the crystallization of component in a temperature range which is not involved in the present control. A variety of temperature ranges can be taken for the "temperature range in which the integral value relative to the total area becomes at least 50%", provided that the range is between the upper end and lower end.

Further, by applying specific cooling conditions to the temperature range in which the integral value relative to the total area becomes at least 70%, the total area of the crystallization peak (Pw) of the wax being taken as 100%, it is possible to control the crystal nuclei of the wax to the preferred state.

The temperature ranges relating to the wax can be determined, in the same manner as for the crystalline polyester. A variety of temperature ranges can be also likewise taken for the "temperature range in which the integral value relative to the total area becomes at least 70%".

In the present invention, a plurality of crystalline polyesters can be also used. In this case, the effects of the present invention can be obtained by applying the above-described cooling step, while satisfying Formula (1) above, to the crystalline polyester with the highest peak temperature of the crystallization peak. Meanwhile, a plurality of waxes can be also used. In this case, the effects of the present invention can be obtained by applying the above-described cooling step, while satisfying Formula (1) above, to the wax with the lowest peak temperature of the crystallization peak.

The preferred embodiments of various materials in the method for producing a toner of the present invention will be explained hereinbelow.

In the present invention, the wax may be constituted by one type of wax, or by two or more types of waxes.

The total amount of the wax in the toner is preferably at least 2.5 parts by mass and not more than 35.0 parts by mass, more preferably at least 4.0 parts by mass and not more than 30.0 parts by mass, and even more preferably at least 6.0 parts by mass and not more than 25.0 parts by mass per 100 parts by mass of the toner.

The peak temperature of the crystallization peak of the wax used in the present invention is preferably at least 50° C. and not more than 90° C.

Examples of the waxes are presented below.

Aliphatic hydrocarbon waxes such as low-molecular-weight polyethylene, low-molecular-weight polypropylene, microcrystalline wax, Fischer-Tropsch waxes, and paraffin waxes; oxides of aliphatic hydrocarbon waxes such as oxidized polyethylene wax, or block, copolymers thereof; waxes mainly composed of fatty esters such as carnauba wax and montanic acid ester wax, and partially or entirely deoxidized fatty acid esters such as deoxidized carnauba wax; saturated straight-chain fatty acids such as palmitic acid, stearic acid, and montanic acid; unsaturated fatty acids such as brassidic acid, eleostearic acid, and parinaric acid; saturated alcohols such as stearyl alcohol, aralkyl alcohol, behenyl alcohol, carnaubyl alcohol, ceryl alcohol, and melissyl alcohol; polyhydric alcohols such as sorbitol; fatty acid amides such as linoleic acid amide, oleic acid amide, and lauric acid amide; saturated fatty acid bisamides such as methylene bis-stearic acid amide, ethylene bis-capric acid amide, ethylene bis-lauric acid amide, and hexamethylene bis-stearic acid amide; unsaturated fatty acid amides such as ethylene bis-oleic acid amide, hexamethylene bis-oleic acid amide, N,N'-dioleyladipic acid amide, and N,N'-dioleylsebacic acid amide; aromatic bisamides such as m-xylene bis-stearic acid amide and N,N'-distearylisophthalic acid amide; aliphatic metal salts (commonly called "metal soaps") such as calcium stearate, calcium laurate, zinc stearate, and magnesium stearate; waxes obtained by grafting a vinyl monomer such as styrene or acrylic acid onto aliphatic hydrocarbon waxes; partial esters of fatty acids with polyhydric alcohols, such as behenic acid monoglyceride; and methyl ester compounds having a hydroxy group which are obtained by hydrogenation of vegetable oils and fats.

In the present, invention, it is preferred that, the wax include an ester wax.

As a result of interaction between the ester bond of the ester wax with the ester bond of the crystalline polyester, the crystal growth of the crystalline polyester easily advances by using the ester wax as crystal nuclei. Therefore, the degree of crystallinity of the crystalline polyester can be easily increased.

Further, in the present invention, the ester wax preferably includes at least either one of an ester compound of a dihydric alcohol and an aliphatic monocarboxylic acid and an ester compound of a dibasic carboxylic acid and an aliphatic monoalcohol (can be referred to hereinbelow also as a bifunctional ester wax). Where one ester bond is present in one molecule of the ester compound, the "monofunctional" expression is used, and where n ester bonds are present the "n-functional" expression is used.

Where the number of ester bonds in the ester wax is increased, the compatibility of the binder resin and the ester wax is improved and the number of formed crystal nuclei is easily increased. Meanwhile, where the number of ester bonds in the ester wax is decreased the effect of interaction by ester bonding to the crystalline polyester is enhanced and the crystal growth of the crystalline polyester is advanced. Therefore, in terms of both the number of the formed crystal nuclei and the advancement of the crystal growth, the bifunctional ester waxes are preferred.

The preferred examples of configurations in which an ester wax has one ester bond include ester compounds of aliphatic monoalcohols with a carbon number of 6 to 12 and long-chain aliphatic monocarboxylic acids and ester compounds of aliphatic monocarboxylic acids with a carbon number of 4 to 10 and long-chain aliphatic monoalcohols. Although any of aliphatic monocarboxylic acids and aliphatic monoalcohols are suitable, monomers may be combined such as to satisfy the peak temperature of the crystallization peak.

Examples of the aliphatic monoalcohols include 1-hexanol, 1-heptanol, 1-octanol, 1-nonanol, 1-decanol, undecyl alcohol, and lauryl alcohol. Further, examples of the aliphatic monocarboxylic acids include pentanoic acid, hexanoic acid, heptanoic acid, octanoic acid, nonanoic acid, and decanoic acid.

Examples of configurations in which an ester wax has two ester bonds include ester compounds of dihydric alcohols and aliphatic monocarboxylic acids and ester compounds of dibasic carboxylic acids and aliphatic monoalcohols.

Examples of the dibasic carboxylic acids include adipic acid, pimelic acid, suberic acid, azelaic acid, decanedioic acid, and dodecanedioic acid.

Examples of the dihydric alcohols include 1,6-hexanediol, 1,7-heptanediol, 1,8-octanediol, 1,9-nonanediol, 1,10-decanediol, 1,11-undecanediol, and 1,12-dodecanediol.

Here, straight-chain carboxylic acids and straight-chain alcohols are exemplified, but they may also have a branched structure.

Among them, 1,6-hexanediol, 1,9-nonanediol, 1,10-decanediol, and 1,12-dodecanediol are preferred, and 1,9-nonanediol and 1,10-decanediol are particularly preferred because the effects of the present invention can be easily demonstrated.

Specific examples of the aliphatic monoalcohols include tetradecanol, pentadecanol, hexadecanol, heptadecanol, octadecanol, nonadecanol, eicosanol, docosanol, tricosanol, tetracosanol, pentacosanol, hexacosanol, and octacosanol. Among them, from the standpoint, of fixing performance and developing performance, docosanol is preferred.

Specific examples of the aliphatic monocarboxylic acids include lauric acid, myristic acid, palmitic margaric acid, stearic acid, tuberculostearic acid, arachidic acid, behenic acid, lignoceric acid and cerotic acid. Among them, from the standpoint, of fixing performance and developing performance, behenic acid is preferred.

Examples of configurations in which the ester wax has three ester bonds include ester compounds of glycerin compounds and aliphatic monocarboxylic acids. Examples of ester waxes that have four ester bonds include ester compounds of pentaerythritol and aliphatic monocarboxylic acids and ester compounds of diglycerol and aliphatic monocarboxylic acids. Examples of ester waxes that have five ester bonds include ester compounds of triglycerol and aliphatic monocarboxylic acids. Examples of ester waxes that have six ester bonds include ester compounds of dipentaerythritol and an aliphatic monocarboxylic acids and ester compounds of tetraglycerol and aliphatic monocarboxylic acids.

In the present invention, it is further preferred that the ester wax have an ester compound and that the ester wax with a controlled composition distribution be used. More specifically, in the composition distribution of the ester wax measured by GC-MASS or MALDI TOF MASS the content ratio of the ester compound with the highest content ratio to the total amount of the ester wax (the ratio of the largest component) is preferably at least 40 mass % and not more than 80 mass %, and more preferably at least 50 mass % and not more than 80 mass %.

This means that the ester wax has a composition distribution, and indicates the degree of the composition distribution. In the above-described step (ii) in which the crystal nuclei of the ester wax are formed, it is preferred that a large amount of crystal nuclei of the ester wax be formed inside the toner. For this purpose, it is preferred that the degree of crystallinity of the ester wax be controlled, to a certain degree.

As a result of the ester wax having the composition distribution, the crystallization rate of the ester wax decreases and the generation of crystal nuclei in a large amount is facilitated as compared with the ester wax having a single composition.

In the present invention, the crystalline polyester is not particularly limited, and well-known crystalline polyesters can be used. It is, however, preferred that the crystalline polyester be a polycondensate of an aliphatic dicarboxylic acid and an aliphatic diol. It is also preferred that the crystalline polyester be saturated.

A polycondensate of a straight-chain aliphatic dicarboxylic acid represented by Formula (A) below and a straight-chain aliphatic diol represented by Formula (B) below is more preferred.

$$HOOC\text{-}(CH_2)_m\text{-}COOH \qquad \text{Formula (A)}$$

(in Formula (A), m is an integer of at least 4 and not more than 14 (preferably at least 6 and not more than 12));

$$HO\text{-}(CH_2)\text{-}_n\text{-}OH \qquad \text{Formula (B)}$$

(in Formula (B), n is an integer of at least 4 and not more than 16 (preferably at least 6 and not more than 12)).

Examples of the aliphatic dicarboxylic acid include oxalic acid, malonic acid, succinic acid, glutario acid, adipic acid, pimelic acid, suberic acid, azelaic acid, sebacic acid, and dodecanedioic acid.

Examples of the aliphatic diol include ethylene glycol, diethylene glycol, triethylene glycol, 1,2-propylene glycol, 1,3-propylene glycol, dipropylene glycol, trimethylene glycol, neopentyl glycol, 1,4-butanediol, 1,5pentanediol, 1,6-hexanediol, 1,7-heptanediol, 1,8-octanediol, 1,9-nonanediol, 1,10-decanediol, 1,11-undecanediol, and 1,12-dodecanediol. The peak temperature of the crystallization peak of the crystalline polyester which is used in the present invention is preferably at least 45° C. and not more than 65° C.

The crystalline polyester which is used in the present invention can be prepared by the usual polyester synthesis method.

For example, the crystalline polyester can be obtained by performing an esterification reaction or a transesterification reaction of a dicarboxylic acid component and a dialcohol component, and then conducting a condensation polymerization reaction in a conventional manner under a reduced pressure or by introducing nitrogen gas.

During the esterification reaction or transesterification reaction, the usual esterification catalyst or transesterification catalyst such as sulfuric acid, tertiary butyl titanium butoxide, dibutyltin oxide, manganese acetate, and magnesium acetate can be used as necessary.

With respect to the condensation polymerization, the usual polymerization catalysts, for example, well-known catalysts such as tertiary butyl titanium butoxide, dibutyltin oxide, tin acetate, zinc acetate, tin disulfide, antimony trioxide, and germanium dioxide can be used. The polymerization temperature and the amount of the catalyst are not particularly limited and can be arbitrarily selected as required.

It is preferred that a titanium catalyst be used as the catalyst, and a chelate-type titanium catalyst is more preferred. This is because titanium catalysts have suitable reactivity and a polyester of a molecular weight distribution desirable in the present invention can be obtained.

In the present invention, the weight-average molecular weight (Mw) of the crystalline polyester is preferably at least 4,000 and not more than 40,000, and more preferably at least 10,000 and not more than 30,000. Where the weight-average molecular weight (Mw) is within the above ranges, it is possible to obtain promptly the plasticizing effect of the crystalline polyester in the fixing step, while maintaining a high degree of crystallinity of the crystalline polyester.

The weight-average molecular weight (Mw) of the crystalline polyester can be controlled by a variety of production conditions of the crystalline polyester.

Meanwhile, the acid value of the crystalline polyester is preferably controlled to a low value when dispersibility in the toner is considered. More specifically, the acid value is preferably at least 0.0 mg KOH/g and not more than 8.0 mg KOH/g, more preferably at least 0.0 mg KOH/g and not more than 5.0 mg KOH/g, and even more preferably at least 0.0 mg KOH/g and not more than 3.5 mg KOH/g.

The crystalline polyester used in the present invention may be a block polymer having a crystalline polyester segment and a vinyl polymer segment. The block polymer is defined as a polymer configured of a plurality of blocks that are linearly connected to each other (Glossary of Basic Terms in Polymer Science, by the International Union of Pure and Applied Chemistry, Compendium of Macromolecular Nomenclature. The Society of Polymer Science, Japan). The present invention follows this definition.

The colorant used in the present invention is not particularly limited, and the following organic pigments, organic dyes, and inorganic pigments can be used.

Examples of cyan colorants include copper phthalocyanine compounds and derivatives thereof, anthraquinone compounds, and basic dye lake compounds. Specific examples are presented below. C.I. Pigment Blue 1, 7, 15, 15:1, 15:2, 15:3, 15:4, 60, 62, and 66.

Examples of magenta colorants include condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specific examples are presented below. C.I. Pigment Red 2, 3, 5, 6, 7, 23, 48:2, 48:3, 48:4, 57:1, 81:1, 122, 14.4, 146, 150, 166, 169, 177, 184, 185, 202, 206, 220, 221, 254, and C.I. Pigment Violet 19.

Examples of yellow colorants include condensed aso compounds, isoindolinone compounds, anthraquinone compounds, azo metal complexes, methine compounds, and allylamide compound. Specific examples are presented below. C.I. Pigment Yellow 12, 13, 14, 15, 17, 62, 74, 83, 93, 94, 95, 97, 109, 110, 111, 120, 127, 128, 129, 147, 151, 154, 155, 168, 174, 175, 176, 180, 181, 185, 191, and 194.

Examples of black colorants include carbon black, magnetic bodies, and colorants toned in black by using the aforementioned yellow colorants, magenta colorants, and cyan colorants.

These colorants can be used individually or as a mixture, and also in a state of solid solution. The colorant to be used in the present invention is selected with consideration for the hue angle, chroma, brightness, light resistance, OHP transparency, and dispersibility in the toner particle.

The amount of the colorant is preferably at least 1 part by mass and not more than 20 parts by mass per 100 parts by mass of the binder resin.

In the present invention, when a magnetic body is used as the colorant, examples of suitable magnetic bodies include iron oxides such as magnetite, maghemite, and ferrite and also iron oxides including other metal oxides; metals such as Fe, Co, and Ni, alloys of those metals with metals such as Al, Co, Cu, Pb, Mg, Mi, Sn, Zn, Sb, Ca, Mn, Se, and Ti, and mixtures thereof.

Specific examples include triiron tetraoxide ($Fe_3O_4$), ferric oxide ($\gamma$-$Fe_2O_3$), zinc iron oxide ($ZnFe_2O_4$), copper iron oxide ($CuFe_2O_4$), neodymium iron oxide ($NdFe_2O_3$), barium iron oxide ($BaFe_{12}O_{19}$), magnesium iron oxide ($MgFe_2O_4$), and manganese iron oxide ($MnFe_2O_4$).

The BET specific surface area of the magnetic body determined by a nitrogen adsorption method is preferably at least: 2.0 $m^2/g$ and not more than 30.0 $m^2/g$, and more preferably at least 3.0 $m^2/g$ and not more than 28.0 $m^2/g$. The Mohs hardness is preferably from at least 5 and not more than 7. The shape of the magnetic body can be polyhedral, octahedral, hexahedral, spherical, acicular, and flaky, but from the standpoint of increasing the image density, shapes with a small anisotropy such as polyhedral, octahedral, hexahedral, and spherical are preferred.

From the standpoint of uniform dispersibility in the toner and color tone, it is preferred that the number-average particle diameter of the magnetic body be at least 0.10 μm and not more than 0.40 μm. Generally, the tinting strength is larger in magnetic bodies with a smaller particle diameter, but such magnetic bodies can easily aggregate.

The number-average particle diameter of the magnetic body can be measured using a transmission electron microscope. Specifically, after the toner to be observed has been sufficiently dispersed in an epoxy resin, curing is performed for 2 days in an atmosphere at a temperature of 40° C. The obtained cured product is cut with a microtome into flaky samples, the cross-sectional image is captured at a magnification of 10,000 times to 40,000 times in a transmission electron microscope (TEM), and the particle diameter of 100 particles of the magnetic body in the cross-sectional image is measured. The number-average particle diameter is then calculated on the basis of the equivalent diameter of the circle equal to the projection area of the magnetic body. The particle diameter may be also measured with an image analysis device.

The magnetic bodies may be used individually or in combinations of two or more thereof.

The amount of the magnetic body is preferably at least 20.0 parts by mass and not more than 150.0 parts by mass, and more preferably at least 50.0 parts by mass and not more than 100.0 parts by mass per 100 parts by mass of the binder resin.

The amount of the magnetic body can be measured using a thermal analysis device "device name: TGA 7, manufactured by PerkinElmer Co., Ltd.". The measurement method is described below.

The toner is heated from the normal temperature to 900° C. at a rate of temperature rise of 25° C./min under a nitrogen atmosphere. The reduction in mass (%) from 100° C. to 750° C. is taken as the binder resin amount, and the residual mass is taken as the approximate amount, of the magnetic body.

The magnetic body can be prepared, for example, by the following method.

Initially, an alkali such as sodium hydroxide is added, in an amount equivalent to, or larger than, that of the iron component, to an aqueous solution of a ferrous salt to prepare an aqueous solution of ferrous hydroxide. The air is blown into the prepared aqueous solution while maintaining the pH thereof at at least 7.0, the oxidation reaction of the ferrous hydroxide is performed while heating the aqueous solution to at least 70° C., and seed crystals serving as the cores of the magnetic iron oxide powder are generated.

Then, an aqueous solution including ferrous sulfate in an amount of about 1 equivalent, as determined on the basis of the previously added amount of the alkali, is added to the slurry including the seed crystals. The reaction of the ferrous hydroxide is advanced while maintaining the pH of the obtained mixture at at least 5.0 and not more than 10.0 and blowing the air, and magnetic iron oxide particles are grown on the seed crystals as cores. At this time, the shape and magnetic properties of the magnetic iron oxide can be controlled by selecting, as appropriate, the pH, reaction temperature, and stirring conditions. The pH of the mixture shifts to the acidic side as the oxidation reaction progresses, but it is preferred that the pH of the mixture do not become less than 5.0.

Further, after completion of the oxidation reaction, it is possible to add a silicon source such as sodium silicate, adjust the pB of the mixture to at least 5.0 and not more than 8.0, and form a coating layer of silicon on the surface of the magnetic iron oxide particles. Magnetic iron oxide can be obtained by filtering, washing, and drying the obtained magnetic iron oxide particles by the usual methods.

Further, when a toner is produced in an aqueous medium, it is preferred that the surface of the magnetic iron oxide be hydrophobized. Where the surface treatment is performed by a dry method, the treatment of the washed, filtered, and dried magnetic iron oxide may be performed by using a coupling agent. Meanwhile, the surface treatment may be also performed by a wet method by redispersing the dry matter of the obtained magnetic iron oxide in a separate aqueous medium after completion of the oxidation reaction, or redispersing the magnetic iron oxide obtained by washing and filtering, without drying, in a separate aqueous medium after completion of the oxidation reaction, and then using a coupling agent. In the present invention the dry method and wet method can be selected, as appropriate.

Examples of the coupling agent include silane compounds, silane coupling agents, and titanium coupling agents. It is preferred that silane compounds and silane coupling agents be used. Examples thereof include those represented by General Formula (I) below.

$$R_mSiY_n \quad \text{Formula (I)}$$

(in Formula (I), R represents an alkoxy group or a hydroxyl group; Y represents an alkyl group, a phenyl group, or a vinyl group; the alkyl group may have an amino group, a hydroxy group, an epoxy group, and a (meth)acryl group as a substituent; m represents an integer of at least 1 and not more than 3; and n represents an integer of at least 1 and not more than 3. However, m+n=4).

Examples of the silane compounds or silane coupling agents represented by General Formula (I) include vinyltrimethoxysilane, vinyltriethoxysilane, vinyltris (β-methoxyethoxy) silane, β-(3,4-epoxycyclohexyl) ethyltrimethoxysilane, γ-glycidoxypropyltrimethoxysilane, γ-glycidoxypropylmethyldiethoxysilane, γ-aminopropyltriethoxysilane, N-phenyl-γ-aminopropyltrimethoxysilane, γ-methacryloxypropyltrimethoxysilane, vinyltriacetoxysilane, methyltrimethoxysilane, dimethyldimethoxysilane, phenyltrimethoxysilane, diphenyldimethoxysilane, methyltriethoxysilane, dimethyldiethoxysilane, phenyltriethoxysilane, diphenyldiethoxysilane, n-propyltrimethoxysilane, isopropyltrimethoxysilane, n-butyltrimethoxysilane, isobutyltrimethoxysilane, trimethylmethoxysilane, n-hexyltrimethoxysilane, n-octyltrimethozysilane, n-octyltriethoxysilane, n-decyltrimethoxysilane, hydroxypropyltrimethoxysilane, n-hexadecyltrimethoxysilane, and n-octadecyltriraethoxysilane, and also hydrolysates thereof. In the present invention, it is preferred that the compound be used in which Y in General Formula (I) is an alkyl group. Among them, an alkyl group preferably has a carbon number of at least 3 and not more than 6, and particularly preferably 3 or 4.

The silane compounds or silane coupling agents can be used individually or in combinations of a plurality thereof. When a plurality thereof is used, the treatment may be performed individually with each coupling agent or simultaneously.

The total, amount of the coupling agent to be used is preferably at least 0.9 part by mass and not more than 3.0 parts by mass per 100 parts by mass of the magnetic body. The amount of the coupling agent may be adjusted according to the surface area of the magnetic body and the reactivity of the coupling agent.

In the present invention, the binder resin is not particularly limited, and the below-described well-known resins suitable for toners can be used.

Homopolymers of styrene and substitution products thereof such as polystyrene and polyvinyl toluene; styrene copolymers such as styrene-propylene copolymer, styrene-vinyl toluene copolymer, styrene-vinyl naphthalene copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer, and styrene-maleic acid ester copolymer; styrene-acrylic resins such as styrene-methyl acrylate copolymer, styrene-ethyl aerylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, and styrene-dimethylaminoethyl methacrylate copolymer; polymethyl methacrylate, polybutyl methacrylate, polyvinyl acetate, polyethylene, polypropylene, polyvinyl butyral, silicone resins, polyester resins, polyamide resins, epoxy resins, and polyacrylic acid resins. These resins can be used individually or in combinations of a plurality thereof. Among them, from the standpoint of developing characteristic and fixing performance, styrene-acrylic resins represented by styrene-butyl acrylate are preferred.

In the present invention, the binder resin includes preferably at least 50 mass % and not more than 100 mass %, and more preferably at least 80 mass % and not more than 100 mass % of a styrene-acrylic resin. Since styrene-acrylic resins are hardly compatible with the crystalline polyesters, the degree of crystallinity of the crystalline polyesters is easily increased.

Examples of polymerizable monomers for forming the styrene-acrylic resin are listed below.

Examples of styrene-based polymerizable monomers include styrene; α-methyl styrene, o-methyl styrene, m-methyl styrene, p-methyl styrene, and p-methoxystyrene.

Examples of acrylic or methacrylic polymerizable monomers include methyl acrylate, ethyl acrylate, n-propyl acrylate, iso-propyl acrylate, n-butyl acrylate, iso-butyl acrylate, tert-butyl acrylate, n-hexyl acrylate, 2-ethylhexyl acrylate, n-octyl acrylate, cyclohexyl acrylate, methyl methacrylate, ethyl methacrylate, n-propyl methacrylate, iso-propyl methacrylate, n-butyl methacrylate, iso-butyl methacrylate, tert-butyl methacrylate, n-hexyl methacrylate, 2-ethylhexyl methacrylate, and n-octyl methacrylate.

These polymerizable monomers can be used individually or in a mixture.

Among these polymerizable monomers, the amount of the styrene-based monomer is preferably at least 60 mass % and not more than 90 mass %, and more preferably at least 65 mass % and not more than 85 mass %. Meanwhile, the amount of the (meth)acrylic acid ester monomer is preferably at least 10 mass % and not more than 40 mass %, and more preferably at least 15 mass % and not more than 35 mass %.

A method for producing the styrene-acrylic resin is not particularly limited, and a well-known method can be used. Further, in the present invention, when the binder resin includes the styrene-acrylic resin, a well-known resin which is used in binder resins for toners can be used, to the extent that does not affect the effects of the present invention, in addition to the styrene-acrylic resin.

In the present invention, a charge control agent may be used to enable the toner to keep stable charging performance regardless of the environment.

Well-known charge control agents can be used, and those that enable a high charging speed and can maintain stably a constant quantity of charge are particularly preferred.

Examples of charge control agents which are capable of charging the toner negatively are presented below.

Monoazo metal compounds, acetylacetone metal compounds, metal compounds of aromatic hydroxycarbaxylic acids, aromatic dicarboxylic acids, hydroxycarboxylic acids, and dicarboxylic acids, aromatic hydroxycarboxylic acids, aromatic mono- and polycarboxylic acids, metal salts, anhydrides, and esters thereof, phenol derivatives such as bisphenol, urea derivatives, metal-containing salicylic acid compounds, metal-containing naphthoic acid compounds, boron compounds, quaternary ammonium salts, calixarenes, and resin-based charge control agents.

Examples of charge control agents which are capable of charging the toner positively are presented below.

Nigrosins and nigrosins modified with fatty acid metal salts; guanidine compounds; imidazole compounds tributylbenzylammonium-1-hydroxy-4-naphthosulfonic acid salts, quaternary ammonium salts such as tetrabutylammonium tetrafluoroborate, onium salts such as phosphonium salts, which are analogs of the quaternary ammonium salts, and lake pigments thereof; triphenylmethane dyes and lake pigments thereof (laking agents include tungstophosphoric acid, molybdophosphoric acid, tungstomolybdophosphoric acid, tannic acid, lauric acid, gallic acid, ferricyanides, and ferrocyanides); metal salts of higher fatty acids; diorganotin oxides such as dibutyltin oxide, dioctyltin oxide, and dicyclohexyltin oxide; diorganotin borates such as dibutyltin borate, dioctyltin borate, and dicyclohexyltin borate; and resin-based charge control agents.

These charge control agents may be used individually or in combinations of two or more thereof.

Among them, other than the resin-based charge control agents, metal-containing salicylic acid compounds are preferred, such compounds in which the metal is aluminum or zirconium are more preferred, and aluminum salicylate compounds are even more preferred.

Among the resin-based charge control agents, polymer's or copolymers having a sulfonic acid group, a sulfonic acid salt group or sulfonic acid ester group, a salicylic acid segment, and an aromatic acid segment: are preferred.

The amount of the charge control agent is preferably at least 0.01 part by mass and not more than 20.0 parts by mass, and more preferably at least 0.05 part by mass and not more than 10.0 parts by mass per 100 parts by mass of the binder resin.

The weight-average particle diameter (D4) of the toner produced according to the present invention is preferably at least 3.0 μm and not more than 12.0 μm, more preferably at least 4.0 μm and not more than 10.0 μm. Where the weight-average particle diameter (D4) is from at least 3.0 μm and not more than 12.0 μm, good flowability is obtained and the latent image can be faithfully developed.

The method of producing the toner of the present invention is characterized by that a coloring particle including a binder resin, a colorant, a crystalline polyester, and a wax is treated in the abovementioned specific step in an aqueous medium.

In the present invention, a well-known method may be used for producing the coloring particle.

For example, where the coloring particle is produced by a pulverisation method, the binder resin, colorant, crystalline polyester, and wax and also optional additives are thoroughly mixed in a mixer such as a Henschel mixer or a ball mill. Melt kneading is then performed using a hot-kneading -machine such as a heating roll, a kneader, and an extruder to disperse or dissolve the materials, and then the coloring particle is obtained through a cooling and solidification step, a pulverization step, a classification step, and an optional surface treatment step.

In the pulverization step, a well-known pulverizing device of a mechanical impact type or a jet type may be used. Further, the pulverization treatment assisted by heating and the treatment in which a mechanical impact force is additionally applied may be also performed. Further, finely pulverised (and optionally classified) coloring particles may be treated by a hot-water bath method in which the particles are dispersed in hot water, or the particles may be passed through a not gas flow.

For example, a method using a pulverizer of a mechanical impact type such as Kryptron System manufactured by Kawasaki Heavy Industries, Ltd. and a turbo mill manufactured by Turbo Rogyo Co., Ltd. can be used for applying a mechanical impact force. It is also possible to press the coloring particle to the inner surface of a casing by a centrifugal force created by a blade rotating at a high speed and apply a mechanical impact force to the coloring particle by a force such as a compression force and a friction force as in devices of a Mechanofusion system manufactured by Hosokawa Micron Group and a hybridization system manufactured by NARA MACHINERY CO., LTD.

Where the coloring particles are produced by a dry method such as the pulverisation method, after the coloring particles are obtained, the coloring particles may be dispersed in an aqueous medium and the abovementioned steps (i), iii), and (iii) may be performed.

A suspension polymerization method and a dissolution suspension method are the preferred examples of methods for producing the coloring particle. Where the coloring particle is produced using the suspension polymerization method and dissolution suspension method, since the coloring particle is produced in an aqueous medium, such methods may be easily incorporated in the producing process. With these production methods, it is easy to achieve the sharp particle size distribution oil the coloring particles, and the increased average circularity of the coloring particles. Further, a coloring particle having a core-shell structure can be also obtained.

An example of producing coloring particles by using the suspension polymerization method will be described below in detail, but this example is not limiting.

A method for producing coloring particles by using the suspension polymerisation method is described below.

Initially, a polymerizable monomer composition is obtained by uniformly dissolving or dispersing the polymerizable monomer constituting a binder resin, a colorant, a crystalline polyester, a wax, and optional components such as a polymerization initiator, a crosslinking agent, a charge control agent, and other additives.

Then, the polymerizable monomer composition is dispersed using a suitable stirrer in a continuous phase (for example, an aqueous medium) including a dispersing agent, and particles of the polymerizable monomer composition are formed in the aqueous medium.

The polymerizable monomer contained in the particles of the polymerizable monomer composition is then polymerized to obtain coloring particles having a desired particle diameter.

The stirring intensity of the stirrer may be selected with consideration for material dispersibility and productivity.

The polymerisation initiator may be added at the same time as the polymerizable monomer and other additives or may be mixed immediately prior to dispersing the polymerizable monomer composition in the aqueous medium. Further, the polymerization initiator dissolved in the polymerizable monomer or solvent can be added immediately after the formation of the particles of the polymerizable monomer composition and before starting the polymerisation reaction.

When the polymerizable monomer is polymerized, the polymerization temperature may be set to at least 40° C., generally to a temperature of at least 50° C. and not more than 90° C.

The polymerizable monomer can be selected from those exemplified as the polymerizable monomers for forming the styrene-acrylic resin.

Polymerization initiators with a half-life in the polymerization reaction of at least 0.5 h and not more than 30 h are preferred. Where the polymerization reaction is conducted by adding at least 0.5 part by mass and not more than 20 parts by mass of the polymerization initiator per 100 parts by mass of the polymerizable monomer, a polymer having a maximum between molecular weights of 5,000 and 50,000 can be obtained.

Examples of specific polymerization initiators include azo-based or diazo-based polymerization initiators such as 2,2'-azobis-(2,4-dimethylvaleronitrile), 2,2'-azobisisobutyronitrile, 1,1'-asobis(cyclohexane-1-carbonitrile), 2,2'-azobis-4-methoxy-2,4-dimethylvaleronitrile, and azobisisobutyronitrile; and peroxide-based polymerization initiators such as benzoyl peroxide, methyl ethyl ketone peroxide, diisopropyl peroxy carbonate, cumene hydroperoxide, 2,4-dichlorobenzoyl peroxide, lauroyl peroxide, t-butyl peroxy-2-ethyl hexanoate, and t-butyl peroxypivalate.

Compounds having two or more polymerizable double bonds are mainly used as the crosslinking agent. Examples thereof include aromatic divinyl compounds such as divinyl benzene and divinyl naphthalene; carboxylic acid esters having two double bonds such as ethylene glycol diacrylate, ethylene glycol dimethacrylate, and 1,3-butanediol dimethacrylate; divinyl compounds, such as divinyl aniline, divinyl ether, divinyl sulfide, and divinyl sulfone; and compounds having three or more vinyl groups. These compounds may be used individually or in combinations of two or more thereof.

The crosslinking agent is preferably added in an amount of at least 0.1 part by mass and not more than 10.0 parts by mass per 100 parts by mass of the polymerizable monomer.

Well-known surfactants, organic dispersing agents and inorganic dispersing agents can be used as the dispersing agent.

Among them, inorganic dispersing agents are preferred because they are unlikely to generate ultrafine particles and can be stably dispersed due to the steric hindrance thereof, thereby preventing collapse of stability even when the reaction temperature is changed and facilitating the washing. Examples of the inorganic dispersing agents include phosphoric acid polyvalent metal salts such as tricalcium phosphate, magnesium phosphate, aluminum phosphate, zinc phosphate,, and hydroxyapatite; carbonates such as calcium carbonate and magnesium carbonate; inorganic salts such as calcium metasilicate, calcium sulfate, and barium sulfate; and inorganic compounds such as calcium hydroxide, magnesium hydroxide, and aluminum hydroxide.

Examples of suitable surfactants include sodium dodecylbenzene sulfate, sodium tetradecyl sulfate, sodium pentadecyl sulfate, sodium octul sulfate, sodium oleate, sodium laurate, sodium stearate, and potassium stearate. The inorganic dispersing agent is added preferably in an amount of at least 0.2 part by mass and not more than 20.0 parts by mass per 100 parts by mass of the polymerizable monomer. The abovementioned dispersing agents may be used individually or in combinations of a plurality thereof. A surfactant may be additionally used in an amount of at least 0.1 part by mass and not more than 10.0 parts by mass.

When the inorganic dispersing agent is used, it may be used as is, but in order to obtain finer particles, the inorganic dispersing agent particles can be produced in an aqueous medium. For example, in the case of tricalcium phosphate, water-insoluble calcium phosphate can be produced by mixing an aqueous solution of sodium phosphate and an aqueous solution of calcium chloride under high-speed stirring to obtain a more uniform and finer dispersion.

When the coloring particles are produced using the suspension polymerization method or dissolution suspension method, since the coloring particles are obtained in a state of being dispersed in an aqueous medium, the following steps (i), (ii) and (iii) may be subsequently performed.

Step (i)

The polymerizable monomer is polymerized to obtain coloring particles, and the temperature of the aqueous medium in which the coloring particles have been dispersed is thereafter raised to a temperature of at least Tw (° C.). In this case, where the polymerization temperature has exceeded Tw (° C.), this operation is not needed.

The aqueous medium is then held at a temperature of at least Tw for a constant time or longer in order to compatibilize the wax and crystalline polyester with the binder resin. The holding time is preferably at least 30 min, more preferably at least 60 min, and even more preferably at least 100 min. Meanwhile, the upper limit value of the holding time is about 1,440 min at which the effect thereof is saturated.

Step (ii)

The aqueous medium is then cooled at a cooling rate of at least 5.0° C./min in a temperature range where an integral value relative to a total area of the Pw becomes at least 70%, the total area being taken as 100%.

Step (iii)

The following step (a) or (b) is then performed:

(a) the aqueous medium is held in a temperature range of the Pp for at least 30 min to obtain a toner particle, (b) the aqueous medium is cooled at a cooling rate of not more than 1.0° C./min in a temperature range where an integral value relative to a total area of the Pp becomes at least 50%, the total area being taken as 100%, to obtain a toner particle.

A toner particle is obtained by implementing the treatment steps including at least the steps (i), (ii), and (iii) and filtering, washing, and drying the slurry including the obtained toner particle by the well-known methods.

A toner may be obtained by optionally adding and mixing an external additive with the toner particle to adhere the external additive thereto. The mixing of the external additive can be performed using a well-known method. For example, a Henschel mixer can be used therefor.

A classification step can be implemented prior to the addition of the external additive, and the coarse or fine powder contained in the toner particles can be cut.

Inorganic fine particles with a number-average particle diameter of primary particles of at least 4 nm and not more than 80 nm (more preferably, at least 6 nm and not more than 40 nm) are preferred as the external additive.

The number-average particle diameter of the primary particles of the inorganic fine particles may be determined by using a photograph of the toner captured under magnification with a scanning electron microscope.

The inorganic fine particles are added to improve the flowability and uniformity of the charging performance of the toner. By subjecting the inorganic fine particles to hydrophobic treatment, it is also possible to impart functions of adjusting the charge quantity of the toner and improving the environmental stability. Examples of treatment agents suitable for the hydrophobic treatment include silicone varnishes, various modified silicone varnishes, silicone oils, various modified silicone oils, silane compounds, silane coupling agents, other organosilicon compounds, and organotitanium compounds. These agents may be used individually or in combinations of two or more thereof.

Examples of the inorganic fine particles include silica fine particles, titanium oxide fine particles, and alumina fine particles. Examples of suitable silica fine particles include the so-called dry silica fine particles which are called dry-method or fumed silica and produced by vapor phase oxidation of silicon halides, as well as the so-called wet silica fine particles produced from water glass.

Further, composite fine particles of silica and another metal oxide can be obtained by using another metal halide such as aluminum chloride and titanium chloride together with the silicon halide in the manufacturing process, and the dry silica fine particles are also inclusive of these composite fine particles.

The amount of the inorganic fine particles added is preferably at least 0.1 mass % and not more than 3.0 mass % with respect to the toner.

Figure 3:
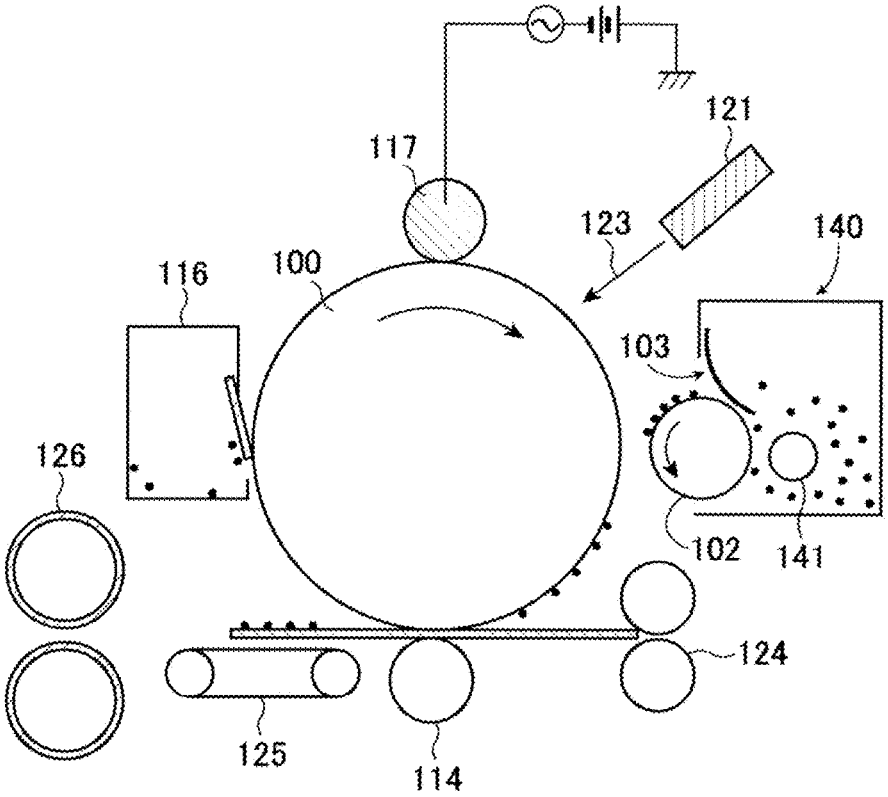
FIG. 3 is a schematic cross-sectional view showing an example of an image forming apparatus.

An example of an image forming apparatus capable of advantageously using the toner will be explained hereinbelow with reference to FIG. 3. In FIG. 3, the reference numeral 100 stands for an electrostatic latent image bearing member (also referred to hereinbelow as "photosensitive member"). A charging member (charging roller) 117, a toner carrying member 102, a developing device 140 having a developing blade 103 and a stirring member 141, a transfer member (transfer charging roller) 114, a cleaner container 116, a fixing unit 126, a pick-up roller 124, and a transport belt 125 are provided on the periphery of the photosensitive member 100.

The photosensitive member 100 is charged by the charging roller 117, for example, to −600 V (the applied voltage is, for example, an AC voltage of 1.85 kVpp and a DC voltage of −620 Vdc). Then, exposure is performed by irradiating the photosensitive member 100 with a laser beam 123 from a laser generator 121, and an electrostatic latent image corresponding to the target image is formed. The electrostatic latent image on the photosensitive member 100 is developed with a single-component toner by the developing device 140 to obtain a toner image, and the toner image is transferred onto a transfer material by the transfer charging roller 114 which is in contact with the photosensitive member, the transfer material being interposed therebetween. The transfer material carrying the toner image is conveyed by the transport belt 125 or the like to the fixing unit 126, and the image is fixed on the transfer material. Further, the toner remaining on parts of the photosensitive member is cleaned with the cleaner container 116. Described herein is an image forming apparatus using magnetic single-component jumping development, but the toner is also suitable for a method using jumping development or contact development.

Methods for measuring various properties according to the present invention are described hereinbelow.

<Method for Measuring Weight-Average Particle Diameter (D4) of the Toner>

The weight-average particle diameter (D4) is calculated in the following manner. A precision particle size distribution measuring device "Coulter-Counter Multisizer 3" (registered trademark, manufactured by Beckman Coulter, Inc.) based on a pore electrical resistance method and equipped with a 100-μm aperture tube is used as a measurement device. The included dedicated software "Beckman Coulter Multisizer 3 version 3.51" (manufactured by Beckman Coulter, Inc.) is used for setting the measurement conditions and analyzing the measured data. The measurements are performed at an effective measurement channel number of 25,000.

An aqueous electrolytic solution used for the measurements is obtained by dissolving reagent-grade sodium chloride in ion-exchanged water to a concentration of about 1 mass %. For example, "ISOTON II" (manufactured by Beckman Coulter, Inc.) can be used.

The dedicated software is set in the following manner before the measurements and analysis are performed.

On the "Change of Standard Measurement Method (SOM)" screen of the dedicated software, the total count number of the control mode is set to 50,000 particles, the number of measurement runs is set to one, and the Kd value is set to a value obtained by using "10.0-μm standard Particles" (manufactured by Beckman Coulter, Inc.). A threshold and a noise level are automatically set by pushing the "Threshold/Noise Level Measurement Button". Further, the current is set to 1,600 μA, the gain is set to 2, the aqueous electrolytic solution is set to ISOTON II, and the "Flush of Aperture Tube After Measurements" is checked.

On the "Setting of Pulse-to-Particle Diameter Conversion" screen of the dedicated software, a bin interval is set to a logarithmic particle diameter, a particle diameter bin is set to the 256 particle size bin, and the particle diameter range is set from 2 μm to 60 μm.

The specific measurement method is described below.

(1) A total of about 200 mL of the aqueous electrolytic solution is placed in a 250-mL round-bottom glass beaker specifically designed for Multisizer 3, and the beaker is set on a sample stand. Agitation with a stirrer rod is performed counterclockwise at 24 rev/s. The dirt and air bubbles in the aperture tube are removed with the function of "Flush of Aperture" of the dedicated software.

(2) A total of about 30 mL of the aqueous electrolytic solution is placed in a 100-mL fiat-bottom glass beaker, and about 0.3 mL of a diluted solution prepared by about 3-fold, in terms of mass, dilution of "Contaminon N" (a 10 mass % aqueous solution of a neutral detergent which has pH of 7 and used for washing precision measurement devices, the neutral, detergent including a nonionic surfactant, an anionic surfactant, and an organic builder; manufactured by Wako Pure Chemical Industries, Ltd.) with ion-exchanged water is added as a dispersing agent thereto.

(3) An ultrasonic disperse "Ultrasonic Dispersion System Tetora 150" (manufactured by Nikkaki Bios Co., Ltd.) is prepared which incorporates two oscillators with an oscillation frequency of 50 kHz in a state with a phase shift of 180 degrees therebetween and which has an electrical output of 120 W. About 3.3 L of ion-exchanged water is placed in a water tank of the ultrasonic disperser, and about 2 mL of the Contaminon N is added to the water tank.

(4) The beaker, as disclosed in clause (2) above, is set in the beaker fixing hole of the ultrasonic disperser, and the ultrasonic disperser is actuated. The height position of the beaker is adjusted such as to maximize the resonance state of the liquid surface of the aqueous electrolytic solution in the beaker.

(5) In a state in which the aqueous electrolytic solution inside the beaker, as disclosed in clause (4) above, is irradiated with ultrasonic waves, about 10 mg of the toner is added portionwise to the aqueous electrolytic solution and dispersed therein. The ultrasonic dispersion treatment is then continued for 60 s. During the ultrasonic dispersion, the temperature of water in the water tank is adjusted, as appropriate, to be at least 10° C. and not more than 40° C.

(6) The aqueous electrolytic solution, as disclosed in clause (5) above, in which the toner has been dispersed, is dropwise added with a pipette to the round-bottom beaker, as disclosed in clause (1) above, which has been placed in the sample stand, and the measured concentration is adjusted to about 5%. The measurements are performed till the number ox measured particles reaches 50,000.

(7) The weight-average particle diameter (D4) is calculated by analyzing the measured data with the dedicated software included with the device. The "Average Diameter" on the "Analysis/Volume Statistical Value (Arithmetic Average)" screen when setting the graph/volume % in the dedicated software is the weight-average particle diameter (D4).

<Measurement Method of Weight-Average Molecular Weight (Mw) of the Crystalline Polyester>

The molecular weight of the crystalline polyester is measured in the following manner by using gel permeation chromatography (GPC).

Initially, the crystalline polyester is dissolved in tetrahydrofuran (THF) at room temperature. The resulting solution is then filtered through solvent-resistant membrane filter "Sample Pretreatment Cartridge" (manufactured by TOSOH CORPORATION) with a pore size of 0.2 μm to obtain a sample solution. The concentration of THF solubles in the sample solution is adjusted to 0.8 mass %. The sample solution is used for measurements under the following conditions.

Device: high-speed GPC apparatus "HLC-8220GPC" (manufactured by TOSOH CORPORATION)

Column: LF-604 series 2 (manufactured by SHOWA DENKO K.K.)

Fluent: THF

Flow velocity: 0.6 mL/min

Oven temperature: 4.00° C.

Sample injection amount: 0.020 mL

When calculating the molecular weight of the sample, a molecular weight calibration curve is used which is prepared using standard polystyrene resins (trade names "TSK Standard Polystyrene F-850, F-450, F-288, F-128, F-80, F-40, F-20, F-10, F-4, F-2, F-1, A-5000, A-2500, A-1000, A-500" manufactured by TOSOH CORPORATION).

<Measurement Method of Molecular Weight and Composition Distribution of Ester Wax>

The composition distribution of the ester wax is obtained by measuring the molecular weight distribution by gel permeation chromatography (GPC) and measuring the range thereof by using gas chromatography (GC) or MALBI TOF MASS. The analytical conditions of the GPC are presented below.

(GPC Measurement Conditions)

Column: GMH-HT (30 cm) series 2 (manufactured by TOSOH CORPORATION)

Temperature: 135° C.

Solvent: o-dichlorobenzene (0.1% ionol addition)

Flow velocity: 1.0 mL/min

Sample: 0.15% sample is injected by 0.4 mL

The measurements are conducted under the above-mentioned conditions, and a molecular weight calibration curve, which is prepared with monodisperse polystyrene standard samples, is used for calculating the molecular weight of the sample. Subsequent calculation is performed by polyethylene conversion based on a conversion formula derived from the Mark-Houwink viscosity equation.

The peaks obtained by the GPC are analyzed, and the maximum value and minimum value of the molecular weight distribution of the ester wax are calculated. When the analysis is performed by the GC-MASS and MALDI TGF MASS in the below-described manner, the region between the maximum and minimum values obtained in the GPC is regarded as the "range of the molecular weight distribution of the ester wax". For the ester wax of the present invention, the measurements can be performed by either one method of the GC-MASS and MALDI TOF MASS, but where the gasification is difficult, the MALDI TOF MASS is selected, as appropriate, and where the matrix and peak overlap, the GC-MASS is selected, as appropriate. The two measurement methods are described below.

(Measurement Conditions of GC-MASS)

Specific conditions for measuring the composition distribution of the ester wax by the GC-MASS are described below.

GC-17A (manufactured by Shimadsu Corporation) is used for the gas chromatography (GC).

A total of 10 mg of the sample is added to 1 mL of toluene, and heated and dissolved for 20 min in a thermostat at 80° C. Then, 1 μL of the solution is injected in a GC apparatus equipped with an on-column injector. Ultra Alloy-1 (HT) (manufactured by Frontier Laboratories Ltd.) with a diameter of 0.5 mm and a length of 10 m is used as the column. The column temperature is initially raised from 40° C. to 200° C. at a speed of temperature rise of 40° C./min, then raised to 350° C. at 15° C./min, and then raised to 450° C. at a speed of temperature rise of 7° C./min. He gas is caused to flow as a carrier gas under a pressure condition of 50 kPa.

The gasified component is introduced in a mass spectrometer, and a group of peaks that is within the above-described "range of the molecular weight distribution of the ester wax" is found by obtaining the molecular weights of a plurality of peaks obtained in the GC. This group of peaks is analyzed and the sum of the peak areas is calculated. Further, among the peaks obtained in the GC, the peak with the largest peak area is taken as a peak (peak derived from the largest component) derived from the ester compound with the largest content ratio in the ester wax.

The content ratio of the ester compound with the largest content ratio to the total amount of the ester wax (ratio of the largest component; mass %) is obtained by finding the ratio of the peak area of the ester compound with the largest content ratio to the total-area of all peaks.

The ester compound is identified by separately injecting an ester compound with a known structure and comparing the same elution time periods, or by introducing the gasified component into a mass spectrometer and performing spectral analysis.

(Measurement Conditions of MALDI TOF MASS)

Described hereinbelow is the case of measuring the composition distribution of the ester wax by the MALDI TOF MASS. The optimum matrix is selected according to the material type and such that the peaks of the matrix do not overlap the peaks derived from the material.

Among the peaks obtained by the MALDI TOF MASS, peaks in the above-described "range of the molecular weight distribution of the ester wax" are found and the sum of the peak intensities is calculated.

Among these peaks, the peak with the maximum intensity is taken as a peak derived from the ester compound with the largest content ratio in the ester wax (peak derived from largest component).

The content ratio (mass %) of the ester compound with the largest content ratio in the ester wax to the total amount of the ester wax is calculated as a ratio of the intensity of the peak derived from the ester compound with the largest content ratio to the sum of the peak intensities.

The ester compound is identified by analyzing the spectrum separately obtained by the MALDI TOF MASS for an ester wax of a known structure.

<Method for Calculating the Exuding Rate of Crystalline Polyester on Toner Surface>

The exuding rate of the crystalline polyester on the toner surface is calculated by the following procedure by using a scanning electron microscope (SEM).

Where the toner is stained with ruthenium, the crystalline polyester contained in the toner can be easily observed with a high contrast. When using ruthenium staining, the amount of the ruthenium atoms differs depending on the intensity of dyeing. Therefore, in a strongly stained portion, there are many ruthenium atoms, an electron beam is not transmitted, and the portion becomes black on the observation image. In a weakly stained portion, an electron beam is easily transmitted, and the portion becomes white on the observation image. In other words, since the crystal line polyester is stained stronger than an amorphous resin, the contrast is clearer and the observation is facilitated.

In the present invention, the exuding rate of the crystalline polyester is calculated by using the image analysis software Image-Pro Plus ver. 5.0 (NIPPON ROPER K.K.) to analyze the toner surface images captured with a Hitachi Ultra-High-Resolution Field-Emission Scanning Electron Microscope S-4800 (Hitachi High-Technologies Corporation). The image capturing conditions for S-4800 are presented below.

(1) Sample Preparation

An electrically conductive paste is thinly applied to a sample stage (aluminum sample stage of 15 mm×6 mm), and the toner is blown thereon. Excess toner is then removed from the sample stage and sufficient drying is performed by air blowing. The sample stage is set in the sample holder, and the height of the sample stage is adjusted to 36 mm with a sample height gauge. The toner is stained for 15 min in a $RuO_4$ atmosphere at 500 Fa by using a vacuum electron staining apparatus (Filgen, Inc., VSC4R1B).

(2) Setting of Observation Conditions for S-4800

The exuding rate of the crystalline polyester is calculated by using the images obtained in reflected electron image observations in the S-4800. In the reflected electron image, the charge-up of inorganic fine particles is less than in the secondary electron image. Therefore, the exuding of the crystalline polyester can be measured with good accuracy.

Liquid nitrogen is injected, until overflowing, into an anti-contamination trap attached to a housing of the S-4800 and allowed to stand for 30 min. The "PC-SEM" of the S-4800 is started, and flushing (cleaning of the FE chip which is an electron source) is performed. The accelerating voltage display portion of the control panel on the screen is clicked, the "FLASHING" button is pushed, and the flushing run dialog is opened. The flushing is performed upon confirming that the flushing intensity is 2. It is confirmed that the emission current created by flushing is 20 μA to 40 μA. The sample holder is inserted into the sample chamber in the housing of the S-4800. The "ORIGIN POINT" on the control panel is pushed, and the sample holder is moved to the observation position.

The accelerating voltage display portion is clicked, the HV setting dialog is opened, the accelerating voltage is set to "0.8 kV", and the emission current is set to "20 μA". In the tab of the "BASIC" on the operation panel, the signal selection is set to "SE", then "UP (U)" and "+BSE" are selected for the SE detector, "L.A.100" is selected in the selection box to the right of "+BSE", and a mode of observation with the reflected electron image is set. Also, in the tab of the "BASIC" on the operation panel, the probe current of the electro-optical system condition block is set to "Normal", the focus mode is set to "UHR", and WD is set to "3.0 mm". The "ON" button on the accelerating voltage display section of the control panel is pushed, and the accelerating voltage is applied.

(3) Calculation of Number-Average Particle Diameter (D1) of Toner

The magnification is set to 5,000 (5 k) by dragging in the magnification display portion on the control panel. The focus knob "COARSE" on the operation panel is rotated, and the adjustment of the aperture alignment is performed, when a certain degree of focus is attained. Then, "Align" on the control panel is clicked, an alignment dialog is displayed, and "BEAM" is selected. The STIGMA/ALIGNMENT knobs (X, Y) on the operation panel are rotated, and the displayed beam is moved to the center of the concentric circles. The "APERTURE" is then selected, the STIGMA/ALIGNMENT knobs (X, Y) are rotated one by one to perform the adjustment such that the motion of the image is stopped or minimized. The aperture dialog is closed and focusing is performed by autofocus. This operation is repeated two more times to focus.

The number-average particle diameter (D1) is then determined by measuring the particle diameter for 300 toner particles. The particle diameter of the individual particles is the maximum diameter at the time of observing the toner particles.

(4) Focus Adjustment

In a state in which the center point of the maximum diameter is aligned with the center of the measurement screen with respect to the particles within ±0.1 μm of the number-average particle diameter (D1) obtained in (3), the magnification is set to 10,000 (10 k) by dragging in the magnification, display portion on the control panel. The focus knob "COARSE" on the operation panel is rotated, and the adjustment of the aperture alignment is performed when a certain degree of focus is attained. Then "Align" on the control panel is clicked, an alignment dialog is displayed, and "BEAM" is selected. The STIGMA/ALIGNMENT knobs (X, Y) of the operation panel are rotated and the displayed beam is moved to the center of the concentric circles. The "APERTURE" is then selected, the STIGMA/ALIGNMENT knobs (X, Y) are rotated one by one to perform the adjustment such that the motion of the image is stopped or minimized. The aperture dialog is closed and focusing is performed by autofocus. The magnification is then set to 5,000 (5 k), focus adjustment is performed using the focus knob and STIGMA/ALIGNMENT knob in the same manner as described above, and focusing is again performed by autofocus. This operation is repeated once again to focus. In this case, since the measurement accuracy of the coverage easily decreases when the inclination angle of the observation surface is large, the analysis is performed by selecting a state with minimized surface inclination by selecting the mode of simultaneous focusing for the entire observation surface at the time of focus adjustment.

(5) Saving the Image

Brightness adjustment is performed in the ABC mode, and the image with a size of 640×480 pixels is captured and saved. The following analysis is performed using the image file. One image is captured for one toner particle, and SEM images are obtained for at least 30 toner particles.

(6) Image Analysis

In the present invention, the exuding rate of the crystalline polyester is calculated by binarizing the images obtained in the procedure mentioned hereinabove by using the below-described analysis software. In this case, the aforementioned one screen is divided into 12 squares and each of them is analyzed. Where an inorganic fine particle with a diameter of at least 50 nm falls into the divided section, the exuding rate of the crystalline polyester is not calculated for this section.

Figure 5:
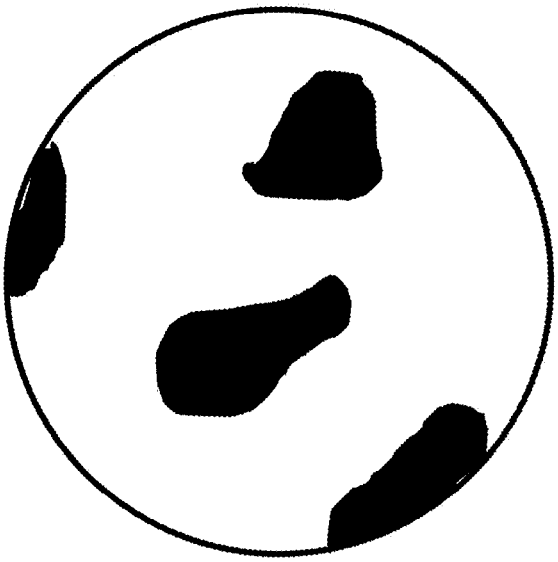
FIG. 5 is a schematic diagram illustrating the exuding of the crystalline polyester in a toner.

The procedure for analysis with the image analysis software Image-Pro Plus ver. 5.0 is described below. The SEM image is picked up by the image analysis software and subjected to filtering at 3×3 pixels. The area A of the toner particle is determined from the outline of the toner. Then, the binarization is performed in the outline of the toner. A threshold calculated by automatic processing is used as a threshold for the binarization. The crystalline polyester is identified by black color, for example, as shown in FIG. 5. The area B identified by black color is then obtained. The exuding rate of the crystalline polyester is calculated using the following equation.

$$\text{Exuding rate of crystalline polyester (\%)} = (\text{Area } B)/(\text{Area } A) \times 100$$

As described above, the calculation of the exuding rate of the crystalline polyester is performed for at least 30 toner particles. The average value of all data obtained is taken as the exuding rate of the crystalline polyester.

<Method for Analyzing the Peak Temperature of the Crystallization Peak and Exothermic Curve of the Crystalline Polyester or Wax>

The peak temperature of the crystallization peak and the exothermic curve of the crystalline polyester or wax is measured using Q1000 (manufactured by TA Instruments) which is a differential scanning calorimeter (DSC).

Temperature correction of the device detector is performed using the melting points of indium and zinc, and the heat of fusion of indium is used for correcting the heat quantity.

More specifically, 1.00 mg of the sample is weighed and placed in an aluminum pan, an empty aluminum pan is used as a reference, and the measurements are conducted under the following conditions.

STANDARD is used as a measurement mode, the temperature is raised from 20° C. to 100° C. at a rate of temperature increase of 10° C./min, and then the temperature is lowered from 100° C. to 20° C. at a rate of temperature decrease of 10° C./min.

Based on the results obtained, the Temperature-Heat Flow graph is created, and the exothermic curve of the crystalline polyester or wax is obtained from the results at the time of lowering the temperature.

In the resulting exothermic curve, the exothermic peak relating to the crystalline polyester is taken as the crystallization peak (Pp) of the crystalline polyester, and the peak temperature of the crystallization peak (Pp) is taken as Tp (° C.).

Meanwhile, the exothermic peak relating to the wax is taken as the crystallization peak (Pw) of the wax, and the peak temperature of the crystallization peak (Pw) is taken as Tw (° C.).

The base line is pulled with respect to the resulting exothermic peak, and a high temperature and a low temperature among the temperatures at which the exothermic curve deviates from the base line are called "upper end" and "lower end", respectively.

The total area of the crystallization peak (Pp) of the crystallization polyester and the total are of the crystallization peak (Pw) of the wax are then determined. The total area of the crystallization peak is the area bounded by the base line and the crystallization peak, where the base line relating to the crystallization peak is pulled.

Where rapid cooling or gradual cooling is performed in a specific temperature range in the step of cooling the aqueous medium, the area bounded by the crystallization peak, base line, and specific temperature range (that is, the integral value of the crystallization peak in the specific temperature range) is determined.

In the below-described examples, the "integral value for the wax subjected to rapid cooling" is indicated as the ratio (%) of the integral value of a crystallization peak (Pw) of the wax in the specific temperature range, the total area of the Pw being taken as 100%.

Meanwhile, the "integral value for the crystalline polyester subjected to gradual cooling" is indicated as the ratio (%) of the integral value of a crystallization peak (Pp) of the crystalline polyester in the specific temperature range, the total area of the Pp being taken as 100%.

The peak temperature of the crystallization peak and the exothermic curve of the crystalline polyester and wax can be also obtained from the toner. As the procedure therefor, the crystalline polyester and the wax may be isolated and the analysis may be implemented with respect to each other.

(Method for Isolation and Structural Analysis of the Crystalline Polyester and Wax)

The toner is extracted with tetrahydrofuran to remove a large portion oil the resin component.

Here, components other than the resin component, such as the magnetic body and external additives, are removed by centrifugal separation using a difference in specific gravity. Since the remaining resin component is a mixture of the crystalline polyester, the wax and the like, the crystalline polyester and the wax may be independently isolated using a fractionation-type LC, and the structure thereof may be analyzed using nuclear magnetic resonance spectroscopy ($^1$H-NMR).

Further, the amount thereof in the toner is determined in the following manner.

For example, the amount of the crystalline polyester can be obtained by comparing the nuclear magnetic resonance spectroscopy results on the toner and the crystalline polyester after the fractionation and finding the area ratio of the peak inherent to the crystalline polyester. The amount of the ester wax can be likewise obtained by the peak area ratio of the nuclear magnetic resonance spectroscopy results.

<Measurement of Acid Value>

The acid value is the number of milligrams of potassium hydroxide required to neutralize the acid contained in 1 g of the sample. The acid value in the present invention is measured according to JIS K0070-1992. More specifically, it is measured according to the following procedure.

(1) Preparation of Reagent

A total of 1.0 g of phenolphthalein is dissolved in 90 mL of ethyl alcohol (95 vol %), and ion-exchanged water is added to obtain 100 mL of a phenolphthalein solution.

A total of 7 g of a reagent-grade potassium hydroxide is dissolved in 5 mL of water, and ethyl alcohol (95 vol %) is added to obtain 1 L. The solution is placed in an alkali-resistant container so as to avoid contact with carbon dioxide, and allowed to stand for 3 days. Subsequent filtration produces a potassium hydroxide solution. The obtained potassium hydroxide solution is stored in an alkali-resistant container. The factor of the potassium hydroxide solution is determined by placing 25 mL of 0.1 mol/L hydrochloric acid into an Erlenmeyer flask, adding several drops of the phenolphthalein solution, titrating with the potassium hydroxide solution, and finding the factor from the amount of the potassium hydroxide solution required for neutralization. The 0.1 mol/L hydrochloric acid is prepared according to JIS K 8001-1998.

(2) Operations (A) Main Test

A total of 2.0 g of the pulverized sample is accurately weighed into a 200-mL Erlenmeyer flask, 100 mL of a mixed solution of toluene:ethanol (2:1) is added, and the sample is dissolved over 5 h. A few drops of the phenolphthalein solution as an indicator are then added and titration is performed using the potassium hydroxide solution. The end point, of the titration is when a thin red color of the indicator is maintained for about 30 s.

(B) Blank Test

The titration is performed by the same operations, except that the sample is not used (that is, only the mixed solution of toluene:ethanol (2:1) is used).

(3) The results obtained are substituted in the following equation and the acid value is calculated.

$$A=[(C-B)\times f\times 5.61]/S$$

Here, A: acid value (mg KOH/g); B: added amount (mL) of potassium hydroxide solution in the blank test; C: added amount (mL) of potassium hydroxide solution in the main test; f: factor of the potassium hydroxide solution; and S: sample (g).

EXAMPLES

The present invention will be explained hereinbelow in greater detail with reference to production examples and embodiments, but the present invention is not limited thereto. "Parts" and "percentages" in the following formulations are all on the mass basis unless specified otherwise.

<Production Example of Magnetic Iron Oxide>

An aqueous solution of a ferrous salt including ferrous hydroxide colloid was obtained by mixing and stirring 55 L of a 4.0 mol/L aqueous solution of potassium hydroxide with 50 L of an aqueous solution of ferrous sulfate including $Fe^{2+}$ at 2.0 mol/L. The resulting aqueous solution was maintained at 85° C., and an oxidation reaction was performed, while blowing air at 20 L/min, to obtain a slurry including core particles.

The resulting slurry was filtered with a filter press and washed, and the core particles were then redispersed in water to obtain a redispersion solution.

Sodium silicate was added to the redispersion solution at 0.20 parts, calculated as silicon, per 100 parts of the core particles, the pH of the redispersion solution was adjusted to 6.0, and a slurry including magnetic iron oxide particles having a silicon-rich surface was obtained by stirring.

The resulting slurry was filtered with a filter press, washed and then redispersed in ion-exchanged water to obtain a redispersion solution.

A total of 500 g (10 mass % with respect to the magnetic iron oxide) of an ion-exchange resin SK110 (manufactured by Mitsubishi Chemical Corporation) was charged into the redispersion solution (solid fraction 50 g/L), and ion exchange was performed by stirring for 2 h. The ion-exchange resin was then filtered and removed with a mesh, filtration and washing were performed with a filter press, and subsequent drying and grinding produced magnetic iron oxide with a number-average size of primary particles of 0.23 μm.

<Production Example of Silane Compound>

A total of 30 parts of iso-butyltrimethoxysilane was dropwise added to 70 parts of ion-exchanged water under stirring. The resulting aqueous solution was held at pH 5.5 and a temperature of 55° C. and dispersed for 120 min at a circumferential rate of 0.46 m/s by using a disper blade to hydrolyze the iso-butyltrimethoxysilane.

The aqueous solution was then adjusted to pH 7.0 and cooled to 10° C. to stop the hydrolysis reaction and obtain an aqueous solution including a silane compound.

<Production Example of Colorant 1>

A total of 100 parts of the magnetic iron oxide was placed in a high-speed mixer (LFS-2; manufactured by Fukae Powtec Corporation), and the aqueous solution including 8.0 parts of the silane compound was dropwise added over 2 min under stirring at a revolution speed of 2,000 rpm. Mixing and stirring were then performed for 5 min.

In order to increase the affixing ability of the silane compound, drying was then performed for 1 h at 40° C., the amount of moisture was reduced, drying was then performed for 3 h at 110° C., and the condensation reaction of the silane compound was advanced.

A colorant 1 was then obtained by grinding and sieving through a sieve with a mesh size of 100 μm.

<Colorant 2>

Commercial carbon black was used as a colorant 2.

The number-average particle diameter of primary particles of the carbon black used was 31 nm, the DPB adsorption was 40 mL/100 g, and the work function was 4.71 eV.

<Production Example of Crystalline Polyester 1>

A total of 183.5 parts of 1,9-nonanediol as an alcohol monomer and 230.3 parts of sebacic acid as a carboxylic acid monomer were charged into a reaction vessel equipped with a nitrogen-introducing tube, a dehydration tube, a stirrer, and a thermocouple. Tin (II) octylate was then added as a catalyst at 1 part per 100 parts of the total amount of the monomers, the reaction system was heated to 140° C. under a nitrogen atmosphere, and the reaction was conducted for 8 h under normal pressure while distilling-off water.

The reaction was then conducted, while raising the temperature to 200° C. at 10° C./h, the reaction was conducted for 2 h after the temperature of 200° C. was reached, the pressure inside the reaction vessel was then reduced to not more than 5 kPa, and the reaction was conducted for 3 h at 200° C. to obtain a crystalline polyester 1.

The acid value of the resulting crystalline polyester 1 was 2.0 mg KOH/g, the weight-average molecular weight (Mw) was 20,000, the melting point (Tm) was 74° C., the peak temperature (Tp) of the crystallization peak was 55° C., the lower end of the crystallization peak was 51° C., and the upper end was 59° C. The physical properties of the resulting crystalline polyester 1 are presented in Table 1.

<Production Examples of Crystalline Polyesters 2 and 3>

Crystalline polyesters 2 and 3 were produced in the same mariner as in the production of the cry steel line polyester 1, except that the alcohol monomer and carboxylic acid monomer were changed as shown in Table 1. The physical properties of the resulting crystalline polyesters 2 and 3 are presented in Table 1.

TABLE 1

| Crystalline polyester | Carboxylic acid monomer | Alcohol monomer | Mw | Acid value (mg KOH/g) | Melting point (° C.) | Peak temperature of crystallization peak (° C.) |
|---|---|---|---|---|---|---|
| Crystalline polyester 1 | Sebacic acid | 1,9-Nonanediol | 20000 | 2.0 | 74 | 55 |

TABLE 1-continued

| Crystalline polyester | Carboxylic acid monomer | Alcohol monomer | Mw | Acid value (mg KOH/g) | Melting point (° C.) | Peak temperature of crystallization peak (° C.) |
|---|---|---|---|---|---|---|
| Crystalline polyester 2 | Dodecanedioic acid | 1,9-Nonanediol | 15000 | 2.6 | 69 | 45 |
| Crystalline polyester 3 | Sebacic acid | 1,9-Nonanediol | 4000 | 2.9 | 81 | 65 |

<Production Example of Ester Compound 1>

A total of 30.0 molar parts of benzene, 200 molar parts of eicosanol as an alcohol monomer, and 100 molar parts of decanedioic acid (sebacic acid) as a carboxylic acid monomer were loaded in a reaction device equipped with a Dimroth, a Dean-Stark water separator, and a thermometer. A total of 10 molar parts of p-toluenesulfonic acid was then added, refluxing for 6 h was performed after thorough stirring and dissolution, and the valve of the water separator was then open to perform azeotropic distillation. After the azeotropic distillation and subsequent thorough washing with sodium bicarbonate, benzene was distilled out by drying. The resulting product was recrystallized, washed, and purified co obtain an ester compound 1.

<Production Examples of Ester Compounds 2 to 5>

Ester compounds 2 to 5 were produced in the same manner as in the production of the ester compound 1, except that, the carboxylic acid monomer and alcohol monomer shown in Table 2 were used.

TABLE 2

| Ester compound | Carboxylic acid monomer | Alcohol monomer |
|---|---|---|
| Ester compound 1 | Sebacic acid | Eicosanol |
| Ester compound 2 | Sebacic acid | Docosanol |
| Ester compound 3 | Sebacic acid | Tetracosanol |
| Ester compound 4 | Behenic acid | Docosanol |

TABLE 2-continued

| Ester compound | Carboxylic acid monomer | Alcohol monomer |
|---|---|---|
| Ester compound 5 | Stearic acid | Pentaerythritol |

<Production Example of Wax 1>

The ester compound 1, ester compound 2, and ester compound 3 were melted and mixed at a compounding ratio shown in Table 3, and the mixture was cooled and ground to obtain a wax 1. The content ratio of the ester compound with the largest content ratio to the total amount of the ester wax (represented in the table as the ratio of the largest component) and the peak temperature (Tw; ° C.) of the crystallization peak, which were measured by the GS-MASS and MALDI TOF MASS, are shown in Table 3.

<Production Examples of Waxes 2 to 6>

Waxes 2 to 6 were obtained in the same manner as in the production example of wax 1, except that, the compounding ratio of the components was changed as shown in Table 3. The physical properties of the resulting waxes 2 to 6 are shown in Table 3.

<Production Examples of Waxes 7 to 9>

The ester compound 2, ester compound 4, and ester compound 5 were used, as is, that is, without melt kneading, as waxes 7 to 9, respectively. The physical properties of the waxes 7 to 9 are shown in Table 3.

<Production Examples of Waxes 10 to 13>

Waxes 10 to 13 which differed in the peak temperature of the crystallization peak were obtained by purifying the commercial paraffin wax "HNP-51 (manufacturer: NIPPON SEIRO CO., LTD.)". The physical properties of the waxes 10 to 13 are shown in Table 3.

TABLE 3

| | Mixing ratio | | | | | | | |
|---|---|---|---|---|---|---|---|---|
| | Component 1 | | Component 2 | | Component 3 | | Peak | Ratio of |
| Wax | Type | Compounding ratio (parts by mass) | Type | Compounding ratio (parts by mass) | Type | Compounding ratio (parts by mass) | temperature of crystallization peak (° C.) | the largest component (mass %) |
| Wax 1 | Ester compound 1 | 15 | Ester compound 2 | 70 | Ester compound 3 | 15 | 75 | 70 |
| Wax 2 | Ester compound 1 | 25 | Ester compound 2 | 50 | Ester compound 3 | 25 | 75 | 50 |
| Wax 3 | Ester compound 1 | 30 | Ester compound 2 | 40 | Ester compound 3 | 30 | 75 | 40 |
| Wax 4 | Ester compound | 35 | Ester compound 2 | 30 | Ester compound 3 | 35 | 75 | 35 |
| Wax 5 | Ester compound 1 | 10 | Ester compound 2 | 80 | Ester compound 3 | 10 | 75 | 80 |
| Wax 6 | Ester compound 1 | 5 | Ester compound 2 | 90 | Ester compound 3 | 5 | 75 | 90 |
| Wax 7 | Ester compound 2 | 100 | — | — | — | — | 75 | 100 |
| Wax 8 | Ester compound 4 | 100 | — | — | — | — | 78 | 100 |

TABLE 3-continued

| Wax | Mixing ratio: Component 1 Type | Component 1 Compounding ratio (parts by mass) | Component 2 Type | Component 2 Compounding ratio (parts by mass) | Component 3 Type | Component 3 Compounding ratio (parts by mass) | Peak temperature of crystallization peak (° C.) | Ratio of the largest component (mass %) |
|---|---|---|---|---|---|---|---|---|
| Wax 9 | Ester compound 5 | 100 | — | — | — | — | 80 | 100 |
| Wax 10 | Paraffin wax 1 | 100 | — | — | — | — | 75 | 100 |
| Wax 11 | Paraffin wax 2 | 100 | — | — | — | — | 70 | 100 |
| Wax 12 | Paraffin wax 3 | 100 | — | — | — | — | 52 | 100 |
| Wax 13 | Paraffin wax 4 | 100 | — | — | — | — | 90 | 100 |

<Production Example of Toner 1>

A total of 450 parts of a 0.1 mol/L aqueous solution of $Na_3PO_4$ was charged into 720 parts of ion-exchanged water, followed by heating to 60° C. A total of 67.7 parts of a 1.0 mol/L aqueous solution of $CaCl_2$ was then added to obtain an aqueous medium including a dispersing agent.

| | |
|---|---|
| Styrene | 79.0 parts |
| n-Butyl acrylate | 21.0 parts |
| Divinylbenzene | 0.6 part |
| Iron complex of monoazo dye (T-77, manufactured by HODOGAYA CHEMICAL CO., LTD.) | 1.5 part |
| Colorant 1 | 90.0 parts |

The above formulation was uniformly dispersed and mixed using an attritor (Mitsui Miike Chemical Engineering Machinery Co., Ltd.) to obtain a polymerizable monomer composition. The polymerizable monomer composition was heated to 63° C., 10 parts of the crystalline polyester 1 and 10 parts of the wax 1 described in Table 3 as an ester wax were added, mixed, and dissolved. Then, 9.0 parts of tert-butylperoxypivalate as a polymerization initiator was dissolved.

The polymerizable monomer composition was charged into the aqueous medium and stirred at 12,000 rpm for 10 min at 60° C. with a TK-type homomixer (Tokushu Rika Kogyo Co., Ltd.) under a nitrogen atmosphere to form particles of the polymerizable monomer composition.

Then, the polymerization reaction was conducted for 4 h at 70° C. while stirring with a paddle stirring blade. After completion of the reaction, the resulting aqueous medium in which the coloring particles were dispersed was heated to 90° C. (temperature of the aqueous medium before cooling step) and held for 30 min.

Then, a cooling step 1 was implemented by charging water at 5° C. into the aqueous medium and rapidly cooling from 90° C. to 59° C. at a cooling rate of 50.00° C./min.

In a cooling step 2, gradual, cooling was then performed from 59° C. to 20° C. at a cooling rate of 0.01° C./min. After washing by adding hydrochloric acid, the aqueous solution was filtered and dried to obtain a toner particle 1.

The ratio of the integral value in the temperature range where cooling was performed at a cooling rate of at least 5.00° C./min was 100% (that is, the "Integral value of wax subjected to rapid cooling" in Table 4 was 100%), the total area of the crystallization peak (Pw) of the wax used being 100%. Further, the ratio of the integral value in the temperature range where cooling was performed at a cooling rate of not more than 1.00° C./min was 100% (that is, the "Integral value of crystalline polyester subjected to gradual cooling" in Table 4 was 100%), the total area of the crystallization peak (Pp) of the crystalline polyester used being 100%.

Then, 100 parts of the toner particles 1 and 0.8 part of hydrophobic silica fine particles having a number-average particle diameter of primary particles of 8 nm and a BET value of 300 $m^2/g$ were mixed using a Henschel mixer (Mitsui Miike Chemical Engineering Machinery Co., Ltd.) to obtain a toner 1. The amount of the styrene-acrylic resin in the binder resin in the resulting toner 1 was 100 mass %. The physical properties of the toner 1 are shown in Table 4.

<Production Examples of Toners 2 to 19 and 21 to 26 and Comparative Toners 1 to 8>

Toners 2 to 19 and 21 to 26 and comparative toners 1 to 8 were produced in the same manner as in the production example of toner 1, except that the type of the crystalline polyester, the type of the wax, the type of the colorant, the addition amount of the amorphous polyester resin, the temperature of the aqueous medium before the cooling step, and the cooling step were changed as shown in Table 4. The physical properties of the resulting toners are shown in Table 4.

In some of the toners, a predetermined number of parts of the amorphous polyester resin was used, as indicated in Table 4. The amorphous polyester used was a saturated polyester resin obtained by a condensation reaction of an ethylene oxide (2 mol) adduce of bisphenol A and terephthalic acid (molar ratio 50:50) and had a weight-average molecular weight (Mw) of 20,000 and an acid value of 0.1 mg KOH/g. The amorphous polyester was added to the polymerizable monomer composition simultaneously with the crystalline polyester.

In the production example of toner 5, the cooling step 2 was implemented by cooling in a temperature range from 70° C. to 60° C., and then rapidly cooling from 60° C. to 2.0° C. at a cooling rate of 2.00° C./min.

In the production example of toner 7, the crystalline polyesters 1 and 2 were used each by 10 parts as the crystalline polyester.

In the production example of the toner 8, waxes 1 and 13 were used each by 10 parts as the wax.

With respect to the toners for which data are presented in the "Holding" column and no data are presented in the "Cooling step 2" column in Table 4, after the cooling step 1 is completed, the temperature of the aqueous medium is kept at a level and for a time indicated in Table 4. The temperature of the aqueous medium was thereafter lowered to 20° C. at a cooling rate of 2.00° C./min.

In all of the temperature ranges for which the cooling rate is not indicated in Table 4, the cooling was advanced at a cooling rate of 2.00° C./min. All of the aqueous media were cooled to 20° C.

The "integral value of the wax subjected to rapid cooling (column D)" in Table 4 means the ratio of the integral value in the temperature range where cooling was performed at a cooling rate of at least 5.00° C./min, the total area of the crystallization peak (Pw) of the wax used being taken as 100%, and the expression "rapid cooling" is used only when the cooling is performed at a cooling rate of at least 5.00° C./min.

The expression "Integral value of the crystalline polyester subjected to gradual cooling (column E)" in Table 4 means the ratio of the integral value in the temperature range where cooling was performed gradually at a cooling rate of not more than 1.00° C./min, the total area of the crystallization peak (Pp) of the crystalline polyester used being taken as 100%", and the expression is used when the cooling is performed at a cooling rate of not more than 1.00° C./min.

<Production Example of Toner 20>

A toner was produced by a dissolution suspension method according to the below-described procedure.

Initially, the aqueous medium and solution were prepared according to the following procedure to obtain the toner.

A total of 660 parts of water and 25 parts of a 48.5 mass % aqueous solution of sodium dodecyl diphenyl ether disulfonate were mixed and stirred, and an aqueous medium was prepared by stirring at 10,000 r/min by using the TK-type homomixer.

The below-described materials were charged into 500 parts of ethyl acetate and a solution was prepared by dissolution at 100 r/min in a propeller-type stirrer.

| | |
|---|---|
| Styrene and n-butyl acrylate copolymer (copolymerization mass ratio is styrene:n-butyl acrylate = 75:25, Mp = 17,000) | 100.0 parts |
| Colorant 2 | 90.0 parts |
| Above-described amorphous polyester | 67.0 parts |
| Crystalline polyester 1 | 10.0 parts |
| Wax 10 | 10.0 parts |

Then, 150 parts of the aqueous medium was placed in a container, stirring was performed at a revolution speed of 12,000 rpm by using the TK-type homomixer, 100 parts of the aqueous solution was added thereto, and mixing was performed for 10 min to prepare an emulsified slurry.

A total of 100 parts of the emulsified slurry was charged into the flask onto which a degassing pipe, a stirrer, and a thermometer were set, and the solvent was removed under reduced pressure over 12 h at 30° C. while stirring at a stirring circumferential rate of 20 m/min. The aqueous medium including the slurry having coloring particles was then heated to 90° C. and held for 30 min. The cooling step was then advanced under the conditions indicated in Table 4.

The aqueous medium was then vacuum filtered, and the resulting filter cake was washed by adding 300 parts of ion-exchanged water. The resulting filter cake was dried for 48 h at 45° C. with a drier, and a toner particle 20 was obtained by sieving with a mesh opening of 75 μm.

A toner 20 was thereafter obtained by mixing 0.8 parts of hydrophobic silica fine particles with 100 parts of the toner particle 20 in the same manner as in the production example of toner 1. The amount of the styrene-acrylic resin in the binder resin in the resulting toner 20 was 60 mass %. The physical properties of the toner 20 are shown in Table 4.

TABLE 4-1

| | | | | | | | Crystallization peak | | | |
|---|---|---|---|---|---|---|---|---|---|---|
| | | | | | | | Wax | | Crystalline polyester | |
| Toner No | Crystalline polyester No. | Wax No. | Number of ester wax functional group | A | B | Colorant No. | Lower end of peak (° C.) | Upper end of peak (° C.) | Lower end of peak (° C.) | Upper end of peak (° C.) |
| 1 | 1 | 1 | 2 | 0 | 100 | 1 | 68 | 80 | 51 | 59 |
| 2 | 1 | 1 | 2 | 0 | 100 | 1 | 68 | 80 | 51 | 59 |
| 3 | 1 | 1 | 2 | 0 | 100 | 1 | 68 | 80 | 51 | 59 |
| 4 | 1 | 1 | 2 | 0 | 100 | 1 | 68 | 80 | 51 | 59 |
| 5 | 3 | 1 | 2 | 0 | 100 | 1 | 68 | 80 | 60 | 68 |
| 6 | 1 | 1 | 2 | 0 | 100 | 1 | 68 | 80 | 51 | 59 |
| 7 | 1 and 2 | 1 | 2 | 0 | 100 | 1 | 68 | 80 | 51 | 59 |
| 8 | 1 | 1 and 13 | 2/— | 0 | 100 | 1 | 68 | 80 | 51 | 59 |
| 9 | 1 | 1 | 2 | 0 | 100 | 2 | 68 | 80 | 51 | 59 |
| 10 | 1 | 2 | 2 | 0 | 100 | 1 | 68 | 80 | 51 | 59 |
| 11 | 1 | 3 | 2 | 0 | 100 | 1 | 68 | 80 | 51 | 59 |
| 12 | 1 | 4 | 2 | 0 | 100 | 1 | 68 | 80 | 51 | 59 |
| 13 | 1 | 5 | 2 | 0 | 100 | 1 | 68 | 80 | 51 | 59 |
| 14 | 1 | 6 | 2 | 0 | 100 | 1 | 68 | 80 | 51 | 59 |
| 15 | 1 | 7 | 2 | 0 | 100 | 1 | 70 | 80 | 51 | 59 |
| 16 | 1 | 7 | 2 | 25 | 80 | 1 | 70 | 80 | 51 | 59 |
| 17 | 1 | 7 | 2 | 67 | 60 | 1 | 70 | 80 | 51 | 59 |
| 18 | 1 | 8 | 1 | 67 | 60 | 1 | 72 | 82 | 51 | 59 |
| 19 | 1 | 9 | 4 | 67 | 60 | 1 | 75 | 85 | 51 | 59 |
| 20 | 1 | 10 | — | 67 | 60 | 2 | 68 | 78 | 51 | 59 |
| 21 | 1 | 10 | — | 67 | 60 | 1 | 68 | 78 | 51 | 59 |
| 22 | 1 | 11 | — | 67 | 60 | 1 | 67 | 73 | 51 | 59 |
| 23 | 2 | 12 | — | 67 | 60 | 1 | 49 | 56 | 40 | 49 |
| 24 | 3 | 13 | — | 67 | 60 | 1 | 87 | 93 | 60 | 68 |
| 25 | 1 | 10 | — | 67 | 60 | 1 | 68 | 78 | 51 | 59 |
| 26 | 1 | 10 | — | 67 | 60 | 1 | 68 | 78 | 51 | 59 |

TABLE 4-1-continued

| Toner No | Crystalline polyester No. | Wax No. | Number of ester wax functional group | A | B | Colorant No. | Crystallization peak: Wax: Lower end of peak (° C.) | Crystallization peak: Wax: Upper end of peak (° C.) | Crystallization peak: Crystalline polyester: Lower end of peak (° C.) | Crystallization peak: Crystalline polyester: Upper end of peak (° C.) |
|---|---|---|---|---|---|---|---|---|---|---|
| Comparative 1 | 1 | 10 | — | 67 | 60 | 1 | 68 | 78 | 51 | 59 |
| Comparative 2 | 1 | 10 | — | 67 | 60 | 1 | 68 | 78 | 51 | 59 |
| Comparative 3 | 1 | 10 | — | 67 | 60 | 1 | 68 | 78 | 51 | 59 |
| Comparative 4 | 1 | 10 | — | 67 | 60 | 1 | 68 | 78 | 51 | 59 |
| Comparative 5 | 1 | 10 | — | 67 | 60 | 1 | 68 | 78 | 51 | 59 |
| Comparative 6 | 1 | 7 | 2 | 67 | 60 | 1 | 70 | 80 | 51 | 59 |
| Comparative 7 | 1 | 7 | 2 | 67 | 60 | 1 | 70 | 80 | 51 | 59 |
| Comparative 8 | 1 | 7 | 2 | 67 | 60 | 1 | 70 | 80 | 51 | 59 |

TABLE 4-2

| Toner No. | C | Cooling step: Cooling step 1: Cooling start temperature (° C.) | Cooling step: Cooling step 1: Cooling stop temperature (° C.) | Cooling step: Cooling step 1: Cooling rate (° C./min) | Cooling step: Cooling step 2: Cooling start temperature (° C.) | Cooling step: Cooling step 2: Cooling stop temperature (° C.) | Cooling step: Cooling step 2: Cooling rate (° C./min) | Cooling step: Holding: Holding temperature (° C.) | Cooling step: Holding: Time (min) | D | E |
|---|---|---|---|---|---|---|---|---|---|---|---|
| 1 | 90 | 90 | 59 | 50.00 | 59 | 20 | 0.01 | — | — | 100 | 100 |
| 2 | 90 | 90 | 59 | 30.00 | 59 | 20 | 0.01 | — | — | 100 | 100 |
| 3 | 90 | 90 | 59 | 10.00 | 59 | 20 | 0.50 | — | — | 100 | 100 |
| 4 | 90 | 90 | 59 | 10.00 | 59 | 20 | 0.70 | — | — | 100 | 100 |
| 5 | 90 | 90 | 68 | 10.00 | 68 | 60 | 0.70 | — | — | 100 | 100 |
| 6 | 90 | 90 | 50 | 10.00 | — | — | — | 55 | 100 | 100 | — |
| 7 | 90 | 90 | 59 | 10.00 | 59 | 20 | 0.07 | — | — | 100 | 100 |
| 8 | 90 | 90 | 59 | 10.00 | 59 | 20 | 0.07 | — | — | 100 | 100 |
| 9 | 90 | 90 | 59 | 10.00 | 59 | 20 | 0.07 | — | — | 100 | 100 |
| 10 | 90 | 90 | 59 | 10.00 | 59 | 20 | 0.07 | — | — | 100 | 100 |
| 11 | 90 | 90 | 59 | 10.00 | 59 | 20 | 0.07 | — | — | 100 | 100 |
| 12 | 90 | 90 | 59 | 10.00 | 59 | 20 | 0.07 | — | — | 100 | — |
| 13 | 90 | 90 | 59 | 10.00 | 59 | 20 | 0.07 | — | — | 100 | 100 |
| 14 | 90 | 90 | 59 | 10.00 | 59 | 20 | 0.07 | — | — | 100 | 100 |
| 15 | 90 | 90 | 59 | 10.00 | 59 | 20 | 0.07 | — | — | 100 | — |
| 16 | 90 | 90 | 59 | 10.00 | 59 | 20 | 0.07 | — | — | 100 | 100 |
| 17 | 90 | 90 | 59 | 10.00 | 59 | 20 | 0.07 | — | — | 100 | 100 |
| 18 | 90 | 90 | 59 | 10.00 | 59 | 20 | 0.07 | — | — | 100 | 100 |
| 19 | 90 | 90 | 59 | 10.00 | 59 | 20 | 0.07 | — | — | 100 | 100 |
| 20 | 90 | 90 | 59 | 10.00 | 59 | 20 | 0.07 | — | — | 100 | 100 |
| 21 | 85 | 85 | 59 | 10.00 | 59 | 20 | 0.07 | — | — | 100 | 100 |
| 22 | 90 | 90 | 59 | 10.00 | 59 | 20 | 0.07 | — | — | 100 | 100 |
| 23 | 90 | 90 | 49 | 10.00 | 49 | 20 | 0.07 | — | — | 100 | 100 |
| 24 | 90 | 90 | 70 | 10.00 | 70 | 20 | 0.07 | — | — | 95 | 100 |
| 25 | 75 | 73 | 55 | 5.00 | 55 | 20 | 1.00 | — | — | 70 | 50 |
| 26 | 75 | 73 | 55 | 5.00 | — | — | — | 55 | 30 | 70 | — |
| Comparative 1 | 73 | 73 | 55 | 5.00 | 55 | 20 | 0.20 | — | — | 70 | 50 |
| Comparative 2 | 75 | 71 | 53 | 5.00 | 53 | 20 | 0.20 | — | — | 60 | 40 |
| Comparative 3 | 75 | 73 | 55 | 3.00 | 55 | 20 | 0.07 | — | — | 0 | 50 |
| Comparative 4 | 75 | 73 | 55 | 5.00 | — | — | — | 50 | 20 | 70 | — |
| Comparative 5 | 75 | 68 | 55 | 3.00 | — | — | — | 50 | 30 | 0 | — |
| Comparative 6 | 90 | 90 | 20 | 30.00 | — | — | — | — | — | 100 | 0 |
| Comparative 7 | 90 | 90 | 20 | 0.01 | — | — | — | — | — | 0 | 100 |
| Comparative 8 | 90 | 90 | 55 | 0.01 | — | — | — | 55 | 30 | 0 | — |

A: amount or amorphous polyester resin added (number of parts)
B: amount of styrene-acrylic resin (mass %)
C: temperature of aqueous medium before cooling step (° C.)
D: integral value (%) of wax subjected to rapid cooling
E: integral value (%) of crystalline polyester subjected to gradual cooling In Tables 4-1 and 4-2, A, B, C, D, and E have the following meaning.

Example 1

(Evaluation of Developing Performance)

The following evaluation was performed using the toner 1.

A commercially available LBP-3100 (manufactured by Canon Inc.) was used as an image forming apparatus, and a printing speed of 16 prints/min was modified to 32 prints/mm. As a result, the developing performance of the toner decreased and more rigorous evaluation could be performed. A color laser copy paper of an A4 type (manufactured by Canon Inc., 80 g/m$^2$) was used.

A solid image was continuously printed 10 times as a printing procedure. The image density of the resulting 10 solid images was measured using a Macbeth reflection densitometer (manufactured by Macbeth Corporation), and the average value thereof was taken as a solid image density. A higher solid density means betted developing performance.

The determination criteria for the developing performance are presented below. The evaluation results are shown in Table 5.

| | | |
|---|---|---|
| A: | at least 1.40 | Very good |
| B: | at least 1.30 and less than 1.40 | Good |
| C: | at least 1.20 and less than 1.30 | Usual |
| D: | less than 1.20 | Poor |

(Evaluation of Fogging)

The following evaluation was performed using the toner 1.

A white image was outputted to the above-described paper, and the reflectance thereof was measured using REFLECTOMETER MODEL TC-6DS manufactured by Tokyo Denshoku Co., Ltd. Meanwhile, the reflectance was measured in the same manner with respect to the paper before the formation of the white image (reference paper). A green filter was used in this process. The fogging was calculated using the formula below from the reflectance before and after the output of the white image.

Fogging (reflectance) (%)−(Reflectance (%) of reference paper)−(Reflectance of white image (%))

The determination criteria for the fogging are presented below. The evaluation results are shown in Table 5.

| | | |
|---|---|---|
| A: | less than 1.00 | Very good |
| B: | at least 1.0 and less than 2.0 | Good |
| C: | at least 2.0 and less than 4.0 | Usual |
| D: | at least 4.0 | Poor |

(Evaluation of Exuding Rate of Crystalline Polyester)

The exuding rate of the crystalline polyester was measured using the above-described method for calculating the exuding rate of the crystalline polyester on the toner surface.

Where the crystalline polyester seeps to the toner surface in a large amount, the occurrence of fogging becomes significant which may cause a reduction in latent electrophotographic characteristics.

The determination criteria for the exuding rate of the crystalline polyester are presented below. The evaluation results are shown in Table 5.

| | | |
|---|---|---|
| A: | less than 5.0% | Very good |
| B: | at least 5.0% and less than 15.0% | Good |
| C: | at least 15.0% and less than 30.0% | Usual |
| D: | at least 30.0% | Poor |

(Procedure of Storage in the Severe Environment)

Figure 4:
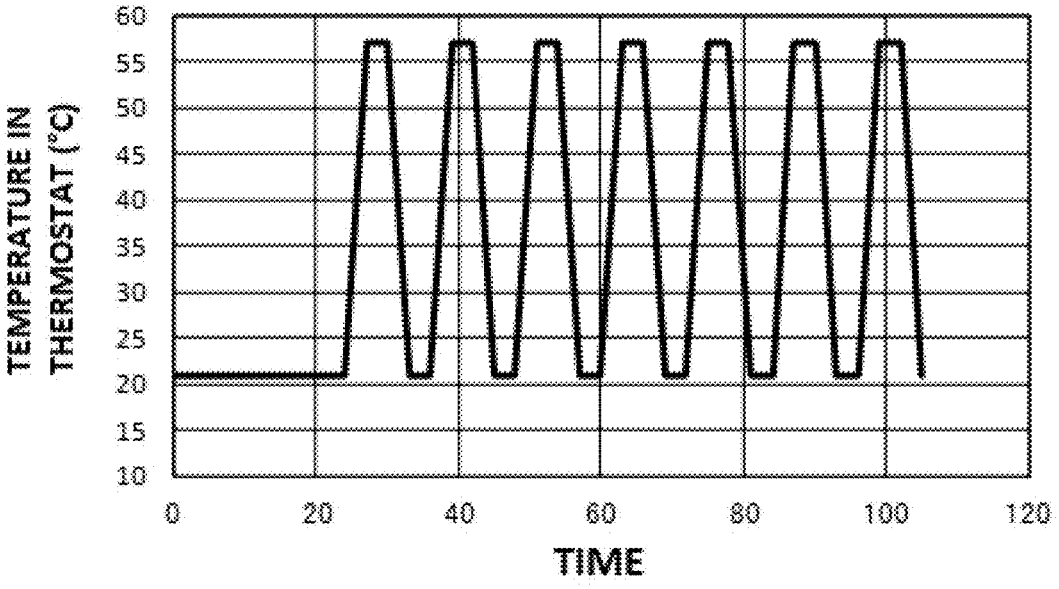
FIG. 4 is a schematic diagram illustrating the procedure of storage in the severe environment.

A total of 5 g of the toner 1 was placed in a thermostat adjusted to a temperature of 21° C. and a relative humidity of 90%, and aging treatment was performed for 24 h. The temperature was then raised over 3 h at a pace of 12° C. per 1 h to adjust the conditions to a temperature of 57° C. and a relative humidity of 90%. After holding for 3 h in this state, the temperature was lowered at a pace of 12° C. per 1 h to return the conditions to a temperature of 21° C. and a relative humidity of 90%. Then, after holding for 3 h, the temperature was raised again. Seven cycles of such increase and decrease in temperature were repeated, as indicated in FIG. 4, between the state with a temperature of 21° C. and a relative humidity of 90% and the state with a temperature of 57° C. and a relative humidity of 90%.

By using such a mode, it is possible to impart rapid thermal fluctuations to the toner and repeatedly raise and lower the toner temperature. As a result, the mass transfer inside the toner is enhanced and exuding of the crystalline polyester to the toner surface is facilitated. In the evaluation relating to the storage in the severe environment, the conditions are severe with respect to the toner.

(Evaluation of Developing Performance, Fogging, and Exuding Rate of Crystalline Polyester after Storage in the Severe Environment)

The developing performance, fogging, and exuding rate of the crystalline polyester were measured by the above-described methods with respect to the toner 1 stored in the severe environment. The evaluation was performed according to the above-described criteria. The evaluation results are shown in Table 5.

In Example 1, good results were obtained with respect to all of the evaluations.

<Examples 2 to 26 and Comparative Examples 1 to 8>

The evaluation same as in Example 1 was performed using the toners 2 to 26 and comparative toners 1 to 8. The obtained results are shown in Table 5.

TABLE 5

| | | Initial | | | | | | After storage in harsh environment | | | | | |
|---|---|---|---|---|---|---|---|---|---|---|---|---|---|
| | Toner No. | Solid image density | Evaluation | Fogging (%) | Evaluation | Exuding rate (%) | Evaluation | Solid image density | Evaluation | Fogging (%) | Evaluation | Exuding rate (%) | Evaluation |
| Example 1 | 1 | 1.49 | A | 0.1 | A | 0.4 | A | 1.48 | A | 0.1 | A | 0.5 | A |
| Example 2 | 2 | 1.45 | A | 0.3 | A | 1.2 | A | 1.45 | A | 0.4 | A | 1.6 | A |
| Example 3 | 3 | 1.42 | A | 0.5 | A | 1.8 | A | 1.40 | A | 0.9 | A | 2.3 | A |

TABLE 5-continued

| | | Initial | | | | | | After storage in harsh environment | | | | | |
|---|---|---|---|---|---|---|---|---|---|---|---|---|---|
| | Toner No. | Solid image density | Evaluation | Fogging (%) | Evaluation | Exuding rate (%) | Evaluation | Solid image density | Evaluation | Fogging (%) | Evaluation | Exuding rate (%) | Evaluation |
| Example 4 | 4 | 1.42 | A | 0.7 | A | 2.3 | A | 1.41 | A | 1.2 | B | 2.8 | A |
| Example 5 | 5 | 1.42 | A | 0.8 | A | 2.2 | A | 1.40 | A | 1.3 | B | 2.8 | A |
| Example 6 | 6 | 1.41 | A | 0.6 | A | 1.8 | A | 1.40 | A | 1.1 | B | 2.3 | A |
| Example 7 | 7 | 1.41 | A | 0.7 | A | 2.3 | A | 1.41 | A | 1.2 | B | 2.9 | A |
| Example 8 | 8 | 1.42 | A | 0.8 | A | 2.4 | A | 1.41 | A | 1.3 | B | 3.0 | A |
| Example 9 | 9 | 1.42 | A | 0.7 | A | 2.3 | A | 1.41 | A | 1.1 | B | 2.7 | A |
| Example 10 | 10 | 1.42 | A | 0.9 | A | 2.8 | A | 1.41 | A | 1.5 | B | 4.0 | A |
| Example 11 | 11 | 1.41 | A | 1.1 | B | 3.5 | A | 1.40 | A | 1.7 | B | 5.8 | B |
| Example 12 | 12 | 1.42 | A | 1.3 | B | 5.2 | B | 1.40 | A | 2.1 | C | 9.1 | B |
| Example 13 | 13 | 1.42 | A | 1.0 | B | 2.8 | A | 1.41 | A | 2.4 | C | 4.1 | B |
| Example 14 | 14 | 1.41 | A | 1.4 | B | 8.1 | B | 1.40 | A | 2.5 | C | 12.1 | B |
| Example 15 | 15 | 1.42 | A | 1.5 | B | 6.3 | B | 1.41 | A | 2.7 | C | 12.5 | B |
| Example 16 | 16 | 1.38 | B | 1.4 | B | 6.7 | B | 1.37 | B | 2.8 | C | 13.1 | B |
| Example 17 | 17 | 1.35 | B | 1.8 | B | 8.5 | B | 1.33 | B | 2.9 | C | 15.2 | C |
| Example 18 | 18 | 1.35 | B | 1.9 | B | 10.3 | B | 1.33 | B | 3.0 | C | 18.2 | C |
| Example 19 | 19 | 1.34 | B | 1.9 | B | 10.5 | B | 1.31 | B | 3.1 | C | 18.4 | C |
| Example 20 | 20 | 1.34 | B | 2.0 | C | 11.6 | B | 1.31 | B | 3.2 | C | 18.5 | C |
| Example 21 | 21 | 1.33 | B | 2.1 | C | 12.5 | B | 1.29 | C | 3.3 | C | 20.2 | C |
| Example 22 | 22 | 1.33 | B | 2.1 | C | 12.7 | B | 1.29 | C | 3.4 | C | 21.0 | C |
| Example 23 | 23 | 1.33 | B | 2.3 | C | 13.5 | B | 1.28 | C | 3.6 | C | 23.5 | C |
| Example 24 | 24 | 1.34 | B | 2.4 | C | 14.0 | B | 1.28 | C | 3.7 | C | 25.6 | C |
| Example 25 | 25 | 1.33 | B | 2.5 | C | 14.8 | B | 1.26 | C | 3.9 | C | 28.4 | C |
| Example 26 | 26 | 1.33 | B | 2.5 | C | 14.8 | B | 1.28 | C | 3.9 | C | 29.1 | C |
| Comparative Example 1 | Comparative 1 | 1.30 | B | 3.1 | C | 21.0 | C | 1.27 | C | 5.3 | D | 42.5 | D |
| Comparative Example 2 | Comparative 2 | 1.29 | C | 3.2 | C | 23.0 | C | 1.23 | C | 6.2 | D | 48.6 | D |
| Comparative Example 3 | Comparative 3 | 1.30 | B | 3.5 | C | 22.1 | C | 1.24 | C | 5.1 | D | 41.2 | D |
| Comparative Example 4 | Comparative 4 | 1.28 | C | 3.1 | C | 19.4 | C | 1.23 | C | 5.0 | D | 38.2 | D |
| Comparative Example 5 | Comparative 5 | 1.30 | B | 3.2 | C | 21.4 | C | 1.23 | C | 5.8 | D | 44.6 | D |
| Comparative Example 6 | Comparative 6 | 1.31 | B | 3.3 | C | 22.4 | C | 1.28 | C | 5.1 | D | 41.2 | D |
| Comparative Example 7 | Comparative 7 | 1.29 | C | 3.1 | C | 18.4 | C | 1.24 | C | 5.0 | D | 38.7 | D |
| Comparative Example 8 | Comparative 8 | 1.31 | B | 3.6 | C | 22.3 | C | 1.25 | C | 5.2 | D | 42.1 | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No, 2015-237857, filed Dec. 4, 2015, which is hereby incorporated by reference herein in its entirety.

What is claimed is:

1. A method for producing a toner comprising a toner particle including a binder resin, a colorant, a crystalline polyester, and a wax, wherein the crystalline polyester and the wax satisfy the following Formula (1), $$45<Tp+5<Tw<100 \quad \text{Formula (1)}$$

where Tp (° C.) represents a peak temperature of a crystallization peak (Pp) in the crystalline polyester measured by differential scanning calorimetry (DSC), and Tw (° C.) represents a peak temperature of a crystallization peak (Pw) in the wax measured by differential scanning calorimetry (DSC), the method comprising the steps of:

(i) setting a temperature of an aqueous medium in which a coloring particle is dispersed to at least the Tw, the coloring particle including the binder resin, the colorant, the crystalline polyester, and the wax;

(ii) cooling the aqueous medium at a cooling rate of at least 5.0° C./min after the step (i) in a temperature range where an integral value relative to a total area of the Pw becomes at least 70%; and (iii) obtaining the toner particle by the following step (a) or (b):

(a) holding the aqueous medium in a temperature range of the Pp for at least 30 min after the step (ii), (b) cooling the aqueous medium at a cooling rate of not more than 1.0° C./min after the step (ii) in a temperature range where an integral value relative to a total area of the Pp becomes at least 50%.

2. The method for producing a toner according to claim 1, wherein the coloring particle is produced by a suspension polymerisation method or a dissolution suspension method.

3. The method for producing a toner according to claim 1, wherein the binder resin includes a styrene-acrylic resin at at least 50 mass % and not more than 100 mass %.

4. The method for producing a toner according to claim 1, wherein the wax includes an ester wax.

5. The method for producing a toner according to claim 4, wherein the ester wax includes an ester compound, and in a composition distribution of the ester wax measured by GC-MASS or MALDI TOF MASS, a content ratio of the ester compound with the highest content ratio to the total amount of the ester wax is at least 40 mass % and not more than 80 mass %.

6. The method for producing a toner according to claim 4, wherein the ester wax includes at least one of an ester compound of a dihydric alcohol and an aliphatic monocarboxylic acid, and an ester compound of a dibasic carboxylic acid and an aliphatic monoalcohol.

* * * * *